US006367128B1

(12) United States Patent
Galkiewicz et al.

(10) Patent No.: US 6,367,128 B1
(45) Date of Patent: Apr. 9, 2002

(54) SELF-MATING RECLOSABLE MECHANICAL FASTENER

(75) Inventors: Robert K. Galkiewicz, Roseville, MN (US); Graham M. Clarke, Bracknell (GB); Ronald W. Ausen, St. Paul; Brian E. Spiewak, Inver Grove Heights, both of MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 0 days.

(21) Appl. No.: 09/501,900

(22) Filed: Feb. 10, 2000

(51) Int. Cl.[7] ..... A44B 18/00

(52) U.S. Cl. ..... 24/585.1; 24/584.1; 24/572.1; 428/100

(58) Field of Search ..... 24/575, 576, 577, 24/587, 580, 306, 442, 452; 604/391; 428/99, 100

(56) References Cited

U.S. PATENT DOCUMENTS

| | | | | |
|---|---|---|---|---|
| 2,532,011 | A | 11/1950 | Dahlquist et al. | 154/53.5 |
| 2,717,437 | A | 9/1955 | De Mestral | 28/72 |
| 2,772,469 | A | 12/1956 | Staller et al. | 24/204 |
| 3,009,235 | A | 11/1961 | De Mestral | 28/78 |

(List continued on next page.)

FOREIGN PATENT DOCUMENTS

| | | | | |
|---|---|---|---|---|
| DE | 31 13 020 | A1 | 11/1982 | |
| EP | 0 046 465 | A1 | 3/1982 | |
| EP | 0 325 528 | A1 | 1/1989 | |
| EP | 0 381 906 | B1 | 2/1993 | |
| EP | 0 793 923 | | 9/1997 | A44B/18/00 |
| EP | 0 250 248 | | 11/1997 | C08G/77/54 |
| EP | 0 904 707 | | 3/1999 | A44B/18/00 |
| EP | 1 034 715 | A2 | 9/2000 | |
| FR | 2 760 974 | A1 | 9/1998 | |
| GB | 1092452 | A * | 11/1967 | |
| JP | 10 245067 | | 9/1998 | |
| WO | WO 91/19433 | | 12/1991 | |
| WO | WO 92/15626 | | 9/1992 | C08F/255/00 |
| WO | WO 99/17630 | | 4/1999 | A44B/18/00 |

*Primary Examiner*—Robert J. Sandy

(57) ABSTRACT

A new self-mating mechanical fastener is disclosed, which comprises a base sheet and a multiplicity of parallel, narrowly spaced, elastically deformable ribs projecting from the base sheet. The ribs comprise a stem portion attached to and substantially upright from the base sheet and at least one flange attached to each side of the stem portion and spaced from the base sheet. At least the outer portions of the flanges desirably project toward the base sheet. The cross-sectional profile formed by the ribs is substantially uniform over the length of the ribs, but in the direction transverse to the ribs has a regularly repeated deviation from the profile that would be formed by a full population of equally spaced, identical, undivided, symmetric ribs. An individual rib has a width that is accommodated between the stem portions of adjacent ribs but is greater than the gap between the facing flanges of adjacent ribs, whereby the ribbed surface of the fastener can be interengaged with and connected to an identical ribbed surface.

68 Claims, 9 Drawing Sheets

U.S. PATENT DOCUMENTS

| | | | | | |
|---|---|---|---|---|---|
| 3,266,113 | A | | 8/1966 | Flanagan, Jr. | 24/204 |
| 3,879,835 | A | | 4/1975 | Brumlik | 29/412 |
| 4,056,593 | A | | 11/1977 | de Navas Albareda | 264/145 |
| 4,290,174 | A | | 9/1981 | Kalleberg | 24/204 |
| 4,313,988 | A | | 2/1982 | Koshar et al. | 428/40 |
| 4,482,687 | A | | 11/1984 | Noshay et al. | 526/125 |
| 4,731,911 | A | | 3/1988 | Gould | 24/587 |
| 4,792,240 | A | * | 12/1988 | Ausnit | 24/587 |
| 4,894,060 | A | | 1/1990 | Nestegard | 604/391 |
| 5,067,210 | A | | 11/1991 | Kayaki | 24/452 |
| 5,119,531 | A | | 6/1992 | Berger et al. | 24/576 |
| 5,235,731 | A | * | 8/1993 | Anzai et al. | 24/576 |
| 5,260,015 | A | | 11/1993 | Kennedy et al. | |
| 5,396,687 | A | | 3/1995 | Osterman | 24/449 |
| 5,398,387 | A | | 3/1995 | Torigoe et al. | 24/452 |
| 5,460,308 | A | | 10/1995 | Hahn | |
| 5,505,747 | A | | 4/1996 | Chesley et al. | 51/297 |
| 5,545,159 | A | * | 8/1996 | Lancaster et al. | 604/391 |
| 5,548,871 | A | | 8/1996 | Trethewey | |
| 5,685,050 | A | | 11/1997 | Murasaki | 24/449 |
| 5,870,849 | A | | 2/1999 | Colson, Jr. | |
| 5,888,621 | A | | 3/1999 | Frohlich et al. | |
| 5,860,194 | A | | 9/1999 | Takizawa et al. | 24/452 |
| 6,060,146 | A | * | 5/2000 | Akeno et al. | 428/100 |
| 6,180,205 | B1 | * | 1/2001 | Tachauer et al. | 428/100 |

* cited by examiner

SELF-MATING RECLOSABLE MECHANICAL FASTENER

FIELD OF THE INVENTION

This invention relates to self-mating reclosable mechanical fasteners, which have structural elements that project from a base sheet and interengage with the structural elements of an identical fastener to thereby connect the fasteners together, as well as connect together articles on which the fasteners have been mounted.

BACKGROUND OF THE INVENTION

Hook-and-loop fasteners (as taught, for example, in U.S. Pat. Nos. 2,717,437 and 3,009,235) are in common, everyday use; but they still have important deficiencies:

the hooks can be rough against bare skin;

the hooks can snag fabrics or other materials that are not intended to be target substrates;

the hooks can collect lint, especially during laundry cycles;

the hook-and-loop composite is a relatively thick laminate, and can be conspicuous, e.g., in clothing applications;

loop material, especially in robust constructions, can be relatively costly;

opening or unfastening hook-and-loop fasteners can cause detachment of loops from their substrates, with a consequent generation of particulate debris; and the potential for particulate debris in hook-and-loop fasteners precludes their use in clean room environments and other areas where debris is destructive.

A wide variety of different fasteners have been taught as alternatives or replacements for hook-and-loop fasteners, including molded and extruded articles from which headed, interengaging elements protrude. See, for example, the fasteners described in U.S. Pat. Nos. 3,266,113; 4,290,174; 4,894,060; and 5,119,531. Many of these fasteners are self-mating, i.e., fastening is accomplished by interengaging fastener units of identical shape.

Despite the many alternative fasteners taught in the prior art, a need still exists for improved fasteners, having new combinations of properties that adapt the fastener for improved performance in existing and new applications. And the improved fastener performance often must be achieved with constructions and processes that give the fasteners a very low manufacturing cost, especially for certain applications such as use on disposable garments or other articles.

SUMMARY OF THE INVENTION

The present invention provides a new self-mating fastener, which comprises a base sheet and a multiplicity of parallel, narrowly spaced, elastically deformable ribs projecting from a major surface of the base sheet. The ribs comprise a stem portion, which is attached to and is substantially upright from the base sheet, and at least one flange attached to each side of the stem portion at points spaced above the base sheet. At least the outer portions of the flanges desirably project downwardly toward the base sheet. The cross-sectional profile of the fastener formed by the ribs is substantially uniform over the length of the ribs; but the profile has a repeated deviation in the direction transverse to the ribs from the profile that would be formed by a full population of identical, equally spaced, undivided, symmetric ribs. The width and spacing of ribs are chosen so that when the ribbed surface of the fastener is pressed against an identical ribbed surface, the ribs of one surface will be accommodated between the ribs of the other surface, and ribs on the two surfaces can deform and their flanges move past one another to interengage and hold the surfaces together.

Fasteners as described have a number of important advantages, as will be discussed in the detailed discussion that follows. These include convenient engagement at a desired level of pressure or force; resistance to disengagement, especially resistance to peel forces, which combines with low engagement force to provide a wide range of utilities; an advantageous self alignment when fasteners are brought into engagement with one another; high durability adapting the fasteners to repeated use; low manufacturing cost; and low inventory cost, given the need to stock only one product in the case of a self-mating fastener.

DETAILED DESCRIPTION

Figure 1:
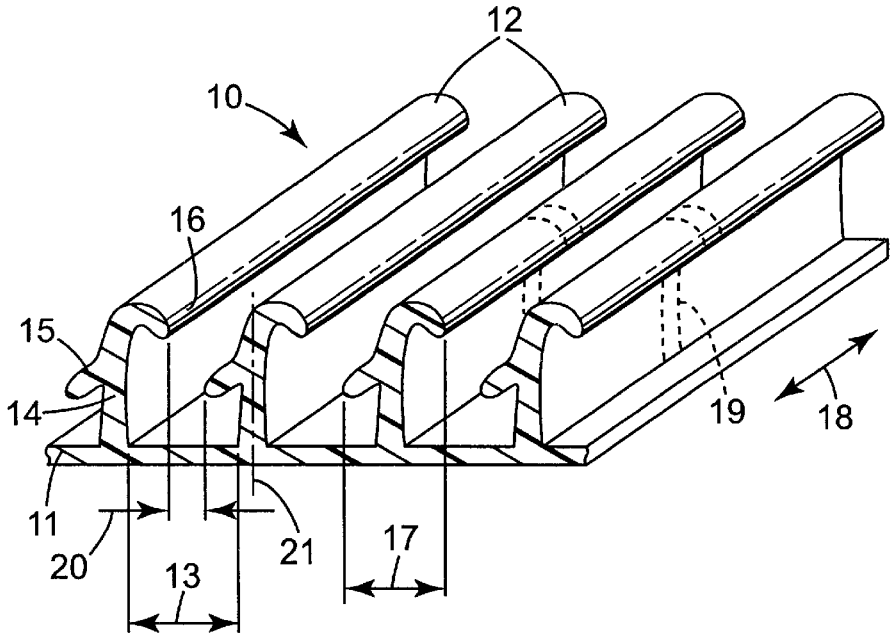
FIG. 1 is a perspective and sectional view of a portion of a representative fastener of the invention.

As illustrated in FIG. 1, a representative fastener of the invention 10 comprises a base sheet 11 and a multiplicity of ribs 12 attached to and projecting upwardly from the base sheet. The ribs 12 are parallel to one another and equally spaced apart a transverse distance 13. Each rib comprises a stem portion 14 and a flange, 15 and 16, attached to each side of the stem portion. Both flanges 15 and 16 are spaced from the base sheet 11, but the right flange 16 is attached to the top of the stem portion 14 while the left flange 15 is attached at a lower height on the stem portion ("right," "left" and "top" refer to positions in FIG. 1; "top" may also be thought of as the surface furthermost from the base sheet). Both flanges 15 and 16 extend at an angle from their point of attachment on the stem portion 14 toward the base sheet 11, with the result that at their outer or lateral edge the flanges are closer to the base sheet than are their points of attachment to the stem portion.

Figure 2A:
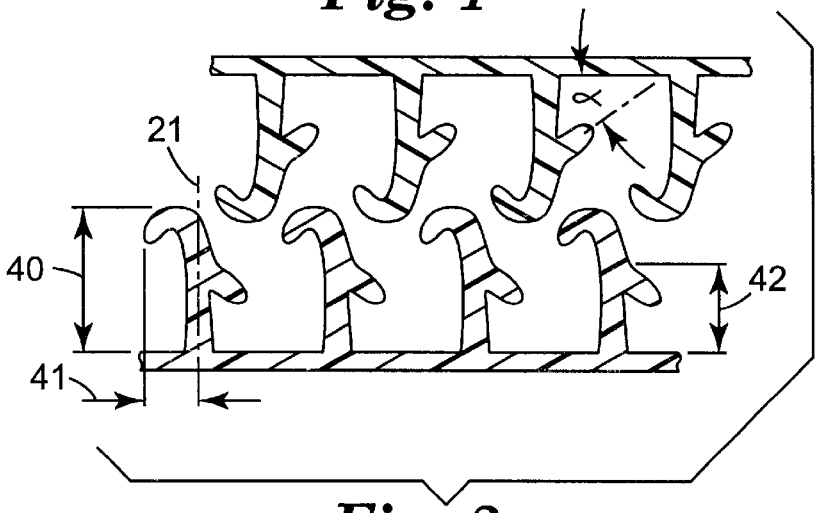
FIGS. 2*a* and 2*b* are sectional views of a portion of the fastener shown in FIG. 1 preparatory to engagement with an identical fastener, showing two different possible orientations of the second fastener.
Figure 2B:
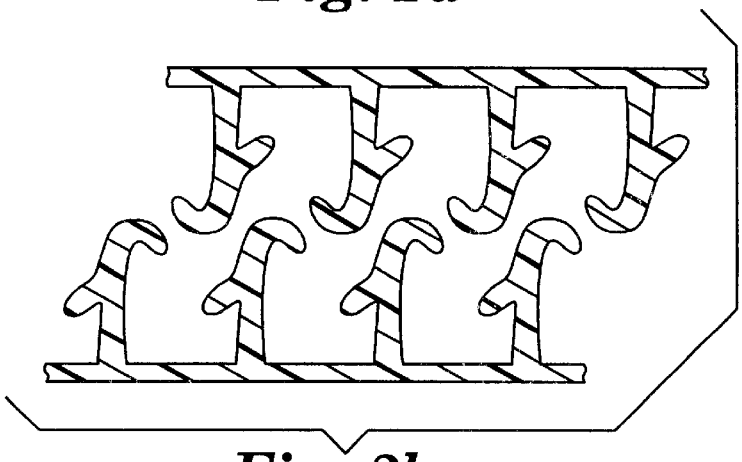

The difference between the flanges 15 and 16 as to their height of attachment to the stem portion 14 makes the ribs 12 asymmetric about a central vertical plane 21. Such an asymmetry has been found to aid the self-mating interengagement of fasteners of the invention, which is illustrated schematically in FIGS. 2–3. As shown first in FIGS. 2*a* and 2*b*, the illustrated fasteners of the invention 10 may have either of two orientations during self-mating interengagement—"same-direction" orientation, with flanges attached at the same height facing the same direction (FIG. 2*a*); and "opposite-direction" orientation, with flanges attached at the same height facing in opposite directions (FIG. 2*b*).

Figure 3A:
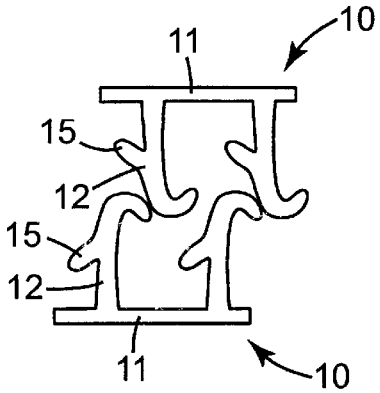
FIGS. 3*a*–3*d* schematically show a portion of a fastener of FIG. 1 as it is interengaged with an identical fastener.
Figure 3B:
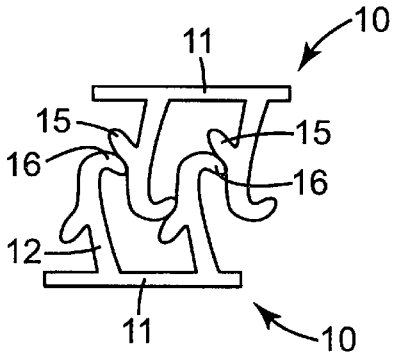
Figure 3C:
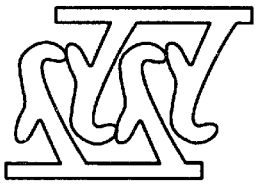
Figure 3D:
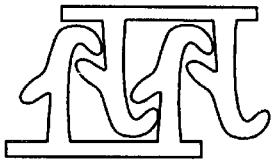

FIGS. 3*a*–3*d* schematically illustrate the movement that individual ribs undergo during engagement of two fasteners 10 arranged in the same-direction orientation. FIG. 3*a* shows the two fasteners, or fastener pair, before engagement (the fasteners will advantageously tend to self-align to the position shown in FIG. 3*a* as they are brought together because the heads of the ribs on one fastener will move into the gap between ribs on the other fastener); FIG. 3*b* shows the fasteners during early engagement; FIG. 3*c* shows the fasteners just before full engagement; and FIG. 3*d*, shows the fasteners in the fully engaged and relaxed stage. As shown, the ribs 12 of the fastener 10 temporarily deform during interengagement, in that the stem portions of the ribs flex from their initial substantially upright position. This flexing is aided by the asymmetric shape of the ribs. For example, as the flange 15 of the right rib of the upper fastener in FIG. 3*b* engages the flange 16 of the right rib of the lower fastener, the top of the lower rib moves to the left ("right" and "left" refer to positions as seen in the drawing); and that leftward movement of the top of the lower rib occurs unimpeded by any structure attached to the left side of the stem of the lower rib at the same height as the flange 16.

The described absence of impeding structure is in contrast to the situation that would exist with symmetrical ribs, e.g., ribs that have identical flanges attached to the stem portion at the same height on each side of the stem portion. The asymmetry of flange height causes a repeated deviation from the profile that would occur with a full population of identical symmetrical ribs, and reduces the force required to accomplish interengagement of the fasteners.

The space 13 between the stems of adjacent ribs accommodates the width 17 of a rib (the transverse distance parallel to the base sheet extending between the opposite outer or lateral edges of the flanges 15 and 16). Flanges in typical fasteners of the invention undergo little if any deformation during engagement, and in that case the space 13 between stems is generally equal to or greater than the width 17 of the ribs. However, the gap between ribs, i.e., the space 20 between facing flanges of the fastener 10 in FIG. 1 (a transverse distance parallel to the base sheet), accommodates the width or thickness of the stem portion, but is less than the width 17 of a rib. Some flexing of the flanges toward the base sheet may assist accommodation of a rib being interengaged between two ribs of a mating fastener, though generally such flexing is not required. If the flanges flex, the spacing 13 may be less than the width 17, but that is not preferred.

The ribs 12 are often continuous over their length 18, but they can be interrupted, as by cutting after extrusion and optionally then stretching the base sheet to form a space between the adjacent ends of the interrupted ribs (shown, for example, by the dotted lines 19 in FIG. 1). Such interruptions can facilitate flexibility of a fastener about an axis transverse to the length of the ribs. In addition, interruptions prepared by pressure on an extruded web, for example, with a hot wheel, can make the base sheet thicker in the area of the interruption (thickened with the material of the ribs which has flowed under pressure of the hot wheel) and these thicker regions can be desirable for sewing of the fastener to a fabric or other substrate. Also, such thickened regions may be useful to provide a barrier to relative sliding movement between mating fasteners, as discussed further below.

By definition, a rib has length, i.e., it is longer than it (or, more precisely, its stem) is wide. Almost always, the ribs are at least 10 times longer than the width of the stem portion, and more typically they are at least 50 or 100 times longer than the width of the stem portion (in some fasteners of the invention in tape form having ribs transverse to the length of the tape, the tape width limits the length of even uninterrupted ribs, for example, to less than 50 or 100 times stem width). However, the ribs will generally function as desired (e.g., bend more readily in the direction of their width rather than their length even when there is longitudinal spacing between ribs) if their length is at least 3 to 5 times the width of their stem portion. When there is little if any longitudinal spacing between ribs, cuts may occur in the ribs at a closer spacing, in which case the cut sections may combine to comprise one rib rather than each cut section functioning as a separate rib.

The length of the ribs and any longitudinal spacing between them are chosen to assure that the ribs will interengage with the ribs of a mating fastener to hold the fasteners together. Longitudinal spacing between ribs seldom averages more than one-half the average length of the ribs, and more typically averages less than one-tenth the average length of the ribs. Interruptions of the rib are not regarded as altering the rib profile of the fastener over its length.

Figure 4A:
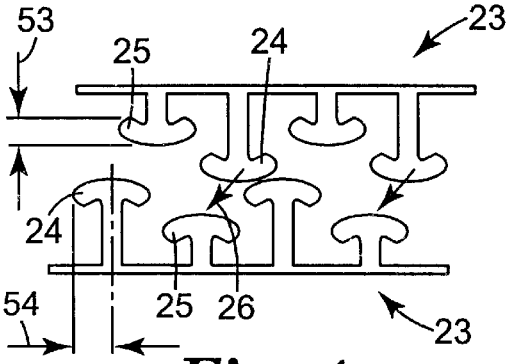
FIGS. 4*a*–4*d* schematically show portions of a different fastener of the invention as it is interengaged with an identical fastener.
Figure 4B:
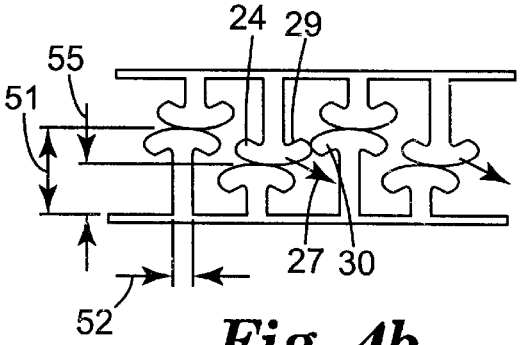
Figure 4C:
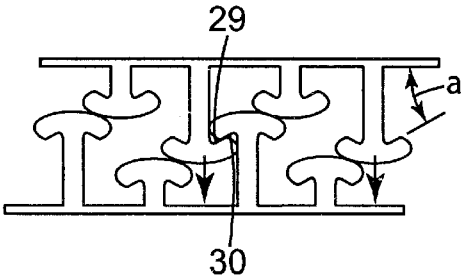
Figure 4D:
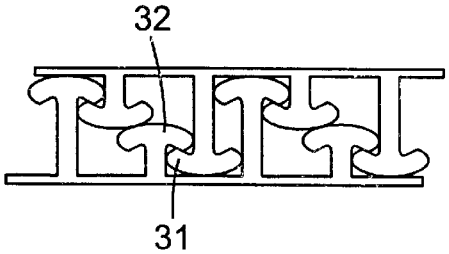

FIGS. 4*a*–4*d* schematically illustrate a different fastener of the invention 23, and show the fastener undergoing interengagement with a duplicate or identical fastener, i.e., as part of a fastener pair. The fastener 23 includes ribs of different height, with tall ribs 24 alternating one-by-one with shorter ribs 25. This repeated deviation from the profile of a full population of identical (e.g., equally tall) symmetrical ribs facilitates a lower-force interengagement of the fasteners. As shown in FIG. 4*a*, the taller ribs 24 contact one another first during interengagement of the fasteners; and as shown by the arrow 26, the heads of the taller ribs tend to move into the gap caused by the shortness of the adjacent ribs 25. This self-aligning of the mating fasteners helps assure an easy and effective interengagement. Upon further pressure on the fasteners, as shown in FIGS. 4*b* and 4*c*, the taller ribs are directed by their contact with the adjacent shorter ribs (see the arrow 27 of FIG. 4*b*) into a position where the right flange 29 of a tall rib 24 of the upper fastener slides under the left flange 30 of a tall rib 24 of the lower fastener ("right" and "left" in this paragraph refer to positions in FIG. 4). Upon further pressure on the fasteners, as shown in FIG. 4d, the left flange 31 of a tall rib 24 of the upper fastener moves under the right flange 32 of a short rib 25 of the lower fastener. The described movement of the head portion of the tall ribs 24 during interengagement occurs unimpeded because there is no structure of equal height adjacent the tall ribs. The lowest-force interengagement is obtained when tall and short ribs alternate with one another one-by-one; but still-desirable, somewhat higher, interengagement forces can be obtained if a lesser ratio of short ribs is used so that some tall ribs are adjacent to one another.

A further desirable performance characteristic of the fastener 23 illustrated in FIGS. 4*a*–4*d* is that the force required to achieve interengagement of a fastener pair is of a serial or two-stage nature. That is, a first exercise of force is required to achieve the first stage of interengagement illustrated in FIGS. 4*b* and 4*c,* and a second, subsequent exercise of force is required to achieve the full interengagement illustrated in FIG. 4*d.* Because of this serial or two-stage exercise of force, the maximum force required at any one time is reduced and interengagement is made easier. Also, a fastener of this type may have two different degrees of interengagement, allowing one lower-force, perhaps temporary interengagement, and a higher-force, perhaps more lasting interengagement.

The difference in height between the tall rib 24 and short rib 25 may vary, but typically should not be so great as to prevent a significant number of tall and short ribs from having complete engagement, i.e., engagement involving the illustrated movement of the flanges of the tall ribs on one fastener of a fastener pair underneath the short ribs of the opposed fastener of the pair. The desired ratio of rib heights will be affected by a number of parameters such as material and thickness of the rib portions and shape of the ribs. Typically, the taller ribs will be about one-fourth to three-fourths again taller than the shorter ribs. With some fasteners of the invention tall ribs on the order of one-and-one-half times the height of the short ribs has achieved preferred results.

Figure 5A:
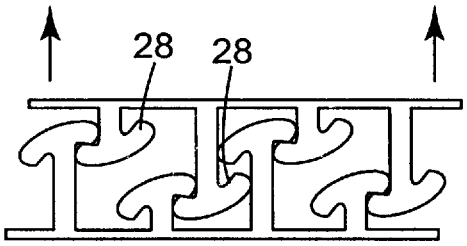
FIGS. 5*a* and 5*b* schematically illustrate disengagement of a pair of fasteners of the type shown in FIGS. 4*a*–4*d*.
Figure 5B:
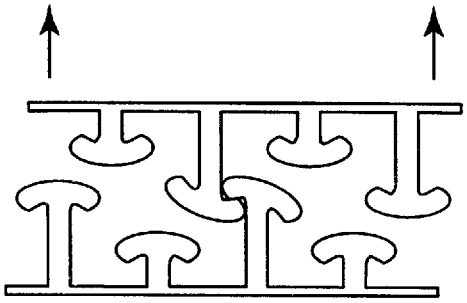

FIGS. 5*a* and 5*b* schematically show the steps of tensile-type disengagement of the fastener pair shown in FIG. 4. As shown, during such disengagement the heads 28 of the ribs tend to twist. They twist in one direction during a first stage of disengagement, and they twist in the opposite direction during a second stage of disengagement. This twisting action involves a bending action of the stem that is different from the typical movement of the stem during engagement. The degree of downward angling of the flanges and the stiffness or resistance to flexing of the flanges affects the degree of twisting required for the heads of the ribs to be freed from engagement with one another.

The tensile disengagement illustrated in FIGS. 5*a* and 5*b* (a similar twisting-head disengagement occurs with the fastener pair illustrated in FIG. 3 and can occur with other fastener pairs of the invention) can result in the tensile disengagement force being higher than the compressive engagement force because of the different and more extreme flexing of the stem portion that occurs during disengagement. This greater force is aided by the fact that the flanges are angled toward the base sheet and by the fact that the flanges preferably undergo little if any deformation during disengagement (or engagement).

FIGS. 6*a*–6*d* schematically illustrate a different fastener of the invention 34 undergoing interengagement with a duplicate or identical fastener. In the fastener 34 a row of ribs is omitted periodically across the width of the fastener to leave a space 35. Such a repeated deviation of the rib profile from the profile of a full population of equally spaced symmetrical ribs reduces interengagement force because ribs are unimpeded during flexure into omitted-row spaces adjacent the flexing ribs. Omission of a row typically occurs with every third, fourth or fifth row. Omission of every third row typically provides the highest ratio of disengagement to engagement forces, but may require careful alignment of fasteners in a fastener pair to assure a desired maximum disengagement force (with closely spaced ribs on one fastener always filled with ribs from the opposed fastener). Such alignment can generally be assured by providing a tape-like fastener pair with two ends pre-attached in the manner of a mechanical zipper.

Figure 7A:
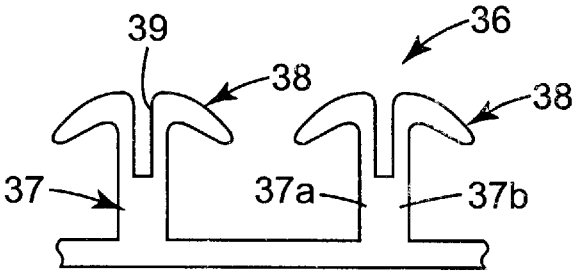
FIGS. 7*a*–7*b* are side or end views of portions of different fasteners of the invention.
Figure 7B:
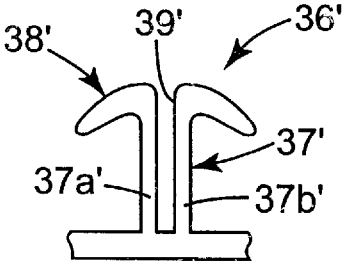

FIGS. 7*a*–7*b* illustrate different fasteners of the invention 36 (36' in FIG. 7*b*) in which the stem 37 (37') of the rib 38 (38') has a substantially vertical (i.e., substantially perpendicular to the base sheet) slot 39 (39') extending from the top through part (FIG. 7*a*) or the full height (FIG. 7b) of the stem. Note that although the slot 39' in FIG. 7*b* essentially divides the stem 37' into two halves 37*a'* and 37*b'*, the two halves function together as one part. The divided stem 37', as well as the divided rib 38', are regarded as one part herein, albeit, a divided part. Upon interengagement of a fastener pair using the type fastener illustrated in FIGS. 7*a*–7*b*, the stem halves 37*a* and 37*b* (37*a'* and 37*b'*) created by the slot 39 (39') flex toward one another to assist the flanges in moving past, and engaging undemeath, flanges of the ribs on the opposed fastener of the fastener pair.

Figure 8A:
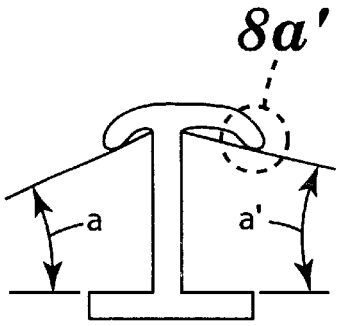
FIGS. 8*a*–8*j* are side or end views of the ribs of different fasteners of the invention, with FIG. 8*a* being an enlarged view of a part of the structure pictured in FIG. 8*a*.
Figure 8A:
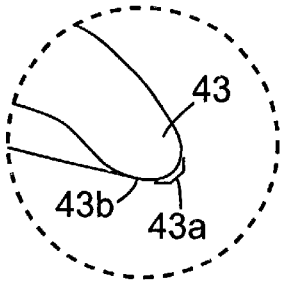
Figure 8B:
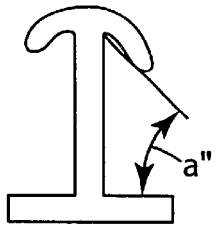
Figure 8C:
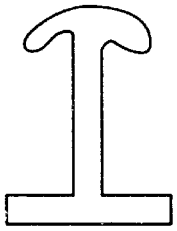
Figure 8D:
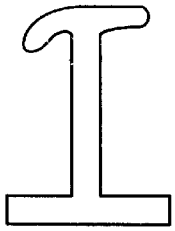
Figure 8E:
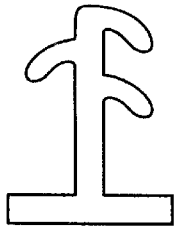
Figure 8F:
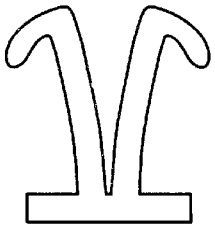
Figure 8G:
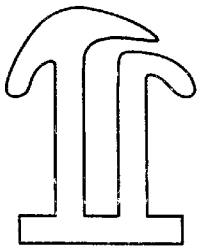
Figure 8H:
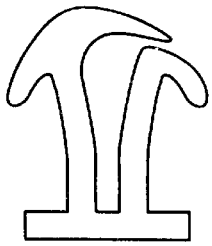
Figure 8I:
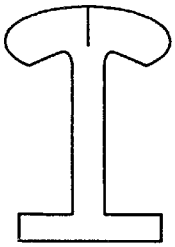

FIGS. 8*a*–8*j* illustrate additional rib shapes for fasteners of the invention. In FIGS. 8*a* and 8*b* one flange is wider than the other flange an/or is angled toward the base sheet at an angle ($\alpha'$, $\alpha''$) different from the angling of the other flange ($\alpha$). In FIG. 8*c* one flange is thicker than the other flange. In FIG. 8*d* one flange curves toward the base sheet while the other flange is substantially parallel to the base sheet. In FIG. 8*e* two flanges are attached to one side of the stem portion and only one flange is attached to the other side. In FIG. 8*f* the slot in the rib is wider at the top and narrows toward the bottom. In FIGS. 8*g* and 8*h* a protective flange at the top of the rib covers a slot in the rib, part of one fastener, for example, a rib half 37*a* or 37*b* pictured in FIGS. 7*a*–7*b*, within the slot between rib halves of the other fastener. The rib in FIG. 8*i* is divided, in that a slit or cut is formed, either during extrusion or by a cutting tool after extrusion, in the top of the rib. Because of this slit, the stem flexes more readily to allow movement of the flanges toward the stem during interengagement of the fastener with a mating fastener, thereby achieving a narrower rib width that facilitates the interengagement process. Upon disengagement of a fastener pair, the flanges are limited in a reverse or disengaging movement by abutment of the divided parts at the slit.

Figure 8J:
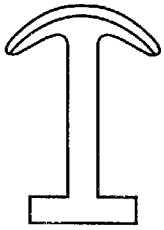

The rib in FIG. 8*j* is a representative coextruded rib, which in this case includes two different materials, one constituting the principal portion of the rib and the other constituting a top portion of the rib. More than two materials may be extruded and may constitute different portions of a rib or base sheet. For example, the base sheet might comprise one material, e.g., for flexibility or suppleness, and the ribs comprise a different material, e.g., a stiffer material. Or the stem portion of a rib may comprise one material, e.g., having flexibility, elasticity, or fatigue-resistant properties desired for repeated flexing, and the head portion, i.e., the top portion of the rib including the flanges, may comprise a different material, e.g., a stiffer, non-flexing material.

Figure 6:
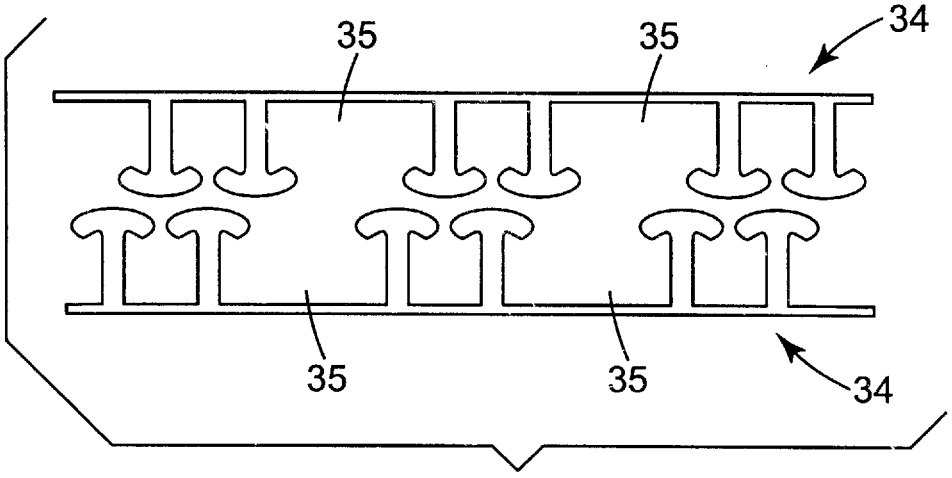
FIG. 6 schematically shows portions of a different fastener of the invention preparatory to interengagement with an identical fastener.

Fasteners of the invention may include combinations of features such as those discussed above. For example, fasteners of the invention may include ribs of the shape illustrated in FIGS. 1, 7*a*–7*b* and 8*a*–8*j* in a tall-short pattern as illustrated in FIGS. 4*a*–4*d* or in an omitted-row pattern as illustrated in FIG. 6. When a combination of features is used, the profile formed by the ribs may have more than one regularly repeated deviation in the direction transverse to the length of the ribs from the profile that would be formed by a full population of equally spaced, identical, undivided, symmetric ribs. ("Full population" means that each potential rib site is occupied, so that ribs cover the intended functional surface of the base sheet—the surface where fastening or engaging is to occur—at a uniform spacing that will achieve interengagement with the ribs of an identical mating fastener.) The asymmetries or profile-deviation features discussed above are illustrative only and are not exhaustive. Profile features may be selected from a variety of features including, as examples only, non-identity of ribs (e.g., some ribs in a regularly repeated pattern being different from other ribs in cross-sectional shape, such as different in rib height, or different in flange shape or flange dimensions), asymmetry of rib shape (e.g., at least some ribs in a regularly repeated pattern being asymmetric in shape about a central vertical plane through the rib), inequality of rib spacing (e.g., the spacing between some ribs being different in a regularly repeated pattern from the spacing between other ribs), and dividing of ribs (e.g., at least some ribs in a regularly repeated pattern having an elongated opening such as a slot, e.g., as in FIGS. 7*a*–7*b*, or slit, e.g., as in FIG. 8*i*, extending generally from the top of the rib at least partially through the height of the rib toward the base sheet).

The size of the ribs may be varied for different applications. Fasteners of the invention will generally function as desired through a range of rib sizes. Depending on composition and rib shape, larger rib sizes often involve larger engagement and disengagement forces than smaller rib sizes. Larger rib sizes may be used for heavy-duty applications, where a fastener pair may be intended to stay engaged longer and/or resist greater disengagement forces; while smaller sizes may be appropriate for lighter-duty applications. The bulk of applications will generally call for a rib height between about 0.25 mm and 3–5 mm. For some applications, such as on diapers, ribs on the order of one or two millimeters or less in height may be preferred. Depending on rib size, ten or more ribs of a fastener are usually interengaged with ribs of another fastener in a mated fastener pair, and more often twenty or more are interengaged.

As illustrated in the drawings, the height of a stem portion (the dimension 40 in FIG. 2*a*) is preferably greater than the width of a flange (the dimension 41 in FIG. 2*a* ) attached to the stem portion. The result (assuming the same thickness and composition for stem and flange) is that the stem portion will tend to flex in preference to flexure of the flanges under the pressure placed on the ribs during interengagement with the ribs of an opposed fastener of a fastener pair. Bending stiffness is generally proportional to $W(T/L)^3$ for a long beam of length L, width W, and thickness T, when bending occurs in the thickness direction. Because the stem is typically longer than the arms, flexing occurs more easily in the stem if the flanges and stem have similar thicknesses and composition. The ease of flexing in both stem and flanges can be controlled by choice of structure, dimensions and modulus of elasticity of the material of the stem and of the flanges.

Whether deformation occurs in stems alone, or in flanges alone, or in both stems and flanges, the ribs are regarded as deformable herein. The deformation that occurs in either stem or flanges is desirably elastic, so that the stem and flange return substantially to their previous shape and position after deformation. For single-use fasteners, permanent deformation of the flanges may occur during disengagement; but any deformation during engagement should be primarily temporary or elastic. Flexure of stems as illustrated above is considered preferable to flexure of flanges, for one reason, because repeated flexure of flanges during repeated closing and opening cycles may lead to permanent deformation of the flanges. Generally, the stems should be perpendicular, or nearly perpendicular, to the base sheet to assure that the stems flex as desired, especially during engagement, and do not become pushed over without interengaging with the ribs of a mating fastener.

For many applications, the lower the force required to achieve engagement while maintaining other desired properties, the better. In contrast to the desire for a lower engagement force, it is generally desired that the disengagement force be high, i.e., higher than what was perceived as the engagement force. Disengagement forces will vary depending on the kind of support that is provided to the fastener. Thus, a fastener of the invention attached to a rigid substrate will generally experience tensile-type disengagement forces acting perpendicular to the plane of the fastener base sheet or shear or cleavage forces acting parallel to the fastener base sheet, and will experience little if any peel-type forces. On the other hand, a fastener of the invention attached to a flexible substrate will experience peel-type forces in addition to tensile and shear forces. An important advantage provided by preferred fasteners of the invention is an improvement in resistance to peel forces.

Tests of engagement and disengagement forces are stated later in this specification, and provide a useful, but not absolute or universal indication of performance. Because of different techniques of causing engagement and disengagement, and differences in the tests for measuring engagement and disengagement forces, it is not always useful to compare numerical values for the various engagement and disengagement forces. Many fasteners of the invention do show a larger peel force for separation than the pinch force required for engagement, which in some cases is an indication of desired performance properties.

Figure 9:
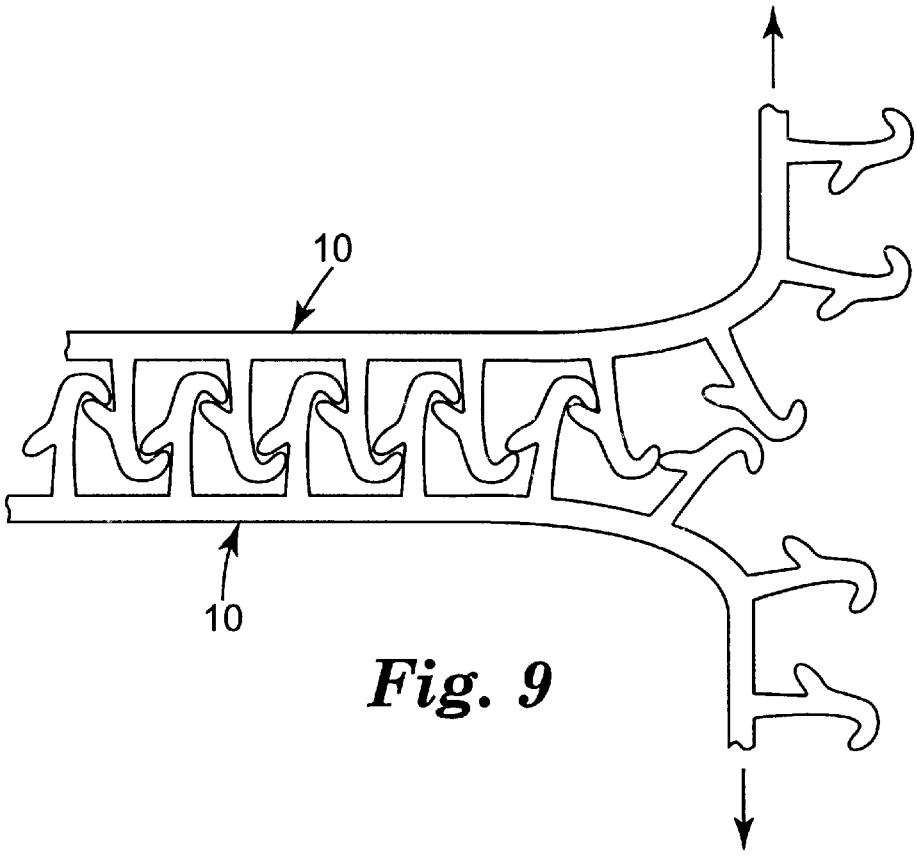
FIGS. 9 and 10 schematically show interengaged pairs of the fasteners of, respectively FIGS. 1 and 4, as they are peeled apart.
Figure 10:
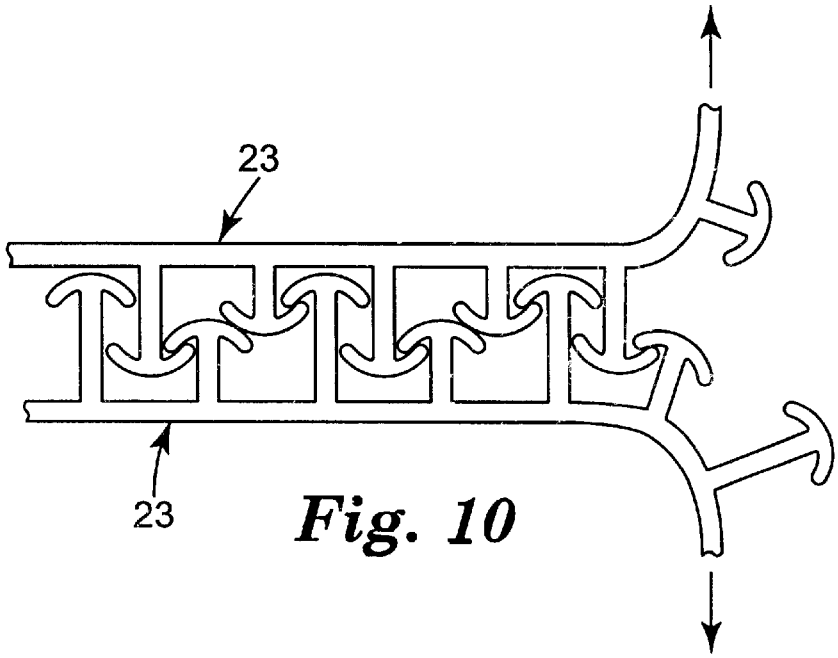

FIGS. 9 and 10 schematically illustrate the movement that fasteners 10 and 23 (shown in FIGS. 1 and 4) undergo during peeling disengagement, as when the fasteners take the form of a tape with ribs transverse to the length of the tape. Such peeling disengagement may occur, for example, when the fasteners are mounted on a flexible substrate such as fabric. The drawings help illustrate how the downwardly angled nature of the flanges increases the force required to separate the fasteners during peeling disengagement. That is, because of the angling down, the flanges remain engaged for a longer time before separating during peeling type disengagement than they would if there were no angling downward.

The improved resistance to disengagement caused by angling of the flanges is a strong reason for using such angling. In addition, angling downward of a constant-thickness flange gives the top surface of the rib an arrowhead or tapered shape (e.g., the width of the top portion or head of the rib gradually increases from its width at the top toward the base sheet), which assists the rib to move between adjacent ribs of a mating fastener during engagement and thus reduces engagement force. The degree of angling (for example, as indicated by the angle $\alpha$ illustrated in FIGS. 2*a*,

8*a* and 8*b* between the flange and the plane of the base sheet) is not always easily or exactly measured, for example, because the flange may have a curved shape. In general, downward angling of an outer portion of the flange, and more specifically downward angling of the underside surface of the outer portion, is important in contributing to higher disengagement forces. By downward angling, it is meant that, from a point closer to the stem to a point further from the stem, the outer underside surface portion is directed on a path of intersection toward the base sheet. Thus the underside surface of the outer portion of the flange is closer to the base sheet than are some more inwardly portions of the underside surface.

Note that "outer" or "outer portion" in the above discussion means generally outer and does not necessarily mean "outermost" or "outermost portion." For example, FIG. 8*a'* pictures in enlarged detail the outer portion 43 of a flange, and shows that even though the outermost underside surface portion 43*a* of the flange may curve upwardly from the bottommost point 43*b* of the flange underside surface, the generally outer portion 43, which constitutes the bulk of the flange portion that moves past a flange during disengagement, curves downwardly. Note also that a flange may curve upwardly from its attachment to the stem portion, in which case portions of the underside surface nearest to the stem may be closer to the base sheet than some underside surface portions further removed from the stem. But at the outer portion of the flange, the underside surface is closer to the base sheet than are some more inwardly underside surface portions. The result is that upon interengagement of a mating pair of fasteners of the invention, edge-portions of interengaged flanges nestle into the space between the flange and the stem portion. The flanges are thus further interconnected in that the flanges have an engaging interference in directions parallel to the base sheet.

The desired degree of angling will vary with the intended application for the fastener, the width of the rib, and the shape, composition and properties of other parts of the rib and fastener, among other factors. Most flanges are angled at least 5 degrees and for many applications are angled at least 20 degrees. The angle of interest may be regarded as the angle between the plane of the base sheet and a line segment that, in most cases extends from the lower edge of the point or area of attachment of the flange to the stem through the bottommost point on the underside of the outer portion of the flange, i.e., the point on the outer portion of the flange closest to the base sheet. If the flange curves upwardly from its point of attachment to the stem portion, so a point on the underside of the flange is higher (spaced further from the base sheet) than the lower edge of the point of attachment, the defining line segment extends from that higher point through the noted bottommost point on the underside of the outer portion of the flange.

FIGS. 9 and 10 illustrate that movement of ribs to allow interengagement or disengagement of fastener pairs can also be provided or assisted by bending of the base sheet. The ease of bending of the base sheet is controlled by its thickness and material properties as well as by the nature of any substrate on which the fastener is mounted.

The fastener of the invention illustrated in FIGS. 4 and 10 has the advantage that it exhibits an equal resistance against peel forces, whichever end of the fastener is peeled apart. That is, whether the peeling separation occurs as shown in FIG. 10 (from the right side in FIG. 10) or from the opposite end (i.e., if the ends of the fastener at the left side of FIG. 10 were pulled apart), the resistance against the peeling forces are the same. This feature occurs because the fastener is basically symmetrical about a vertical plane through an individual rib. The fastener of the invention illustrated in FIGS. 1 and 9 has the advantage that it exhibits directionality, e.g., in its resistance against peel forces, because the fastener is basically asymmetrical about a vertical plane through an individual rib (such as the plane 21 in FIG. 1).

Figure 11:
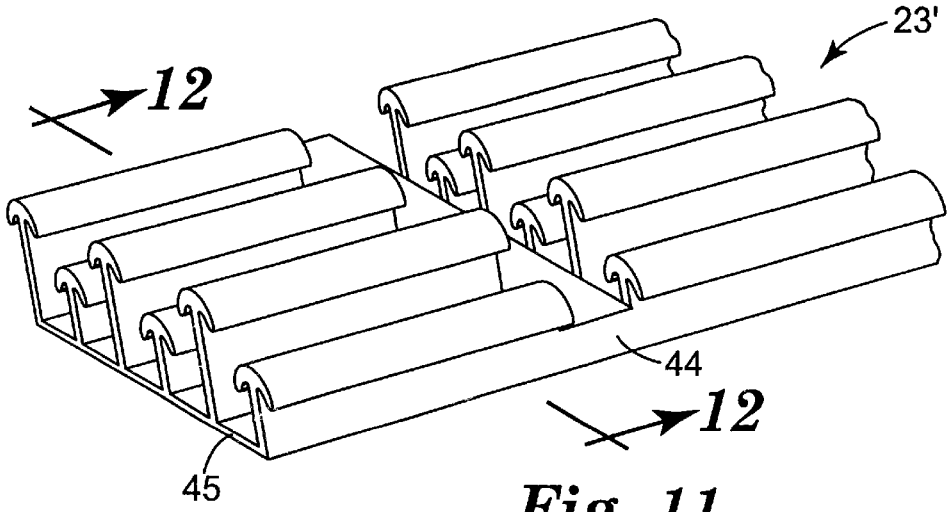
FIG. 11 is a perspective, partial view of a different fastener of the invention.
Figure 12:
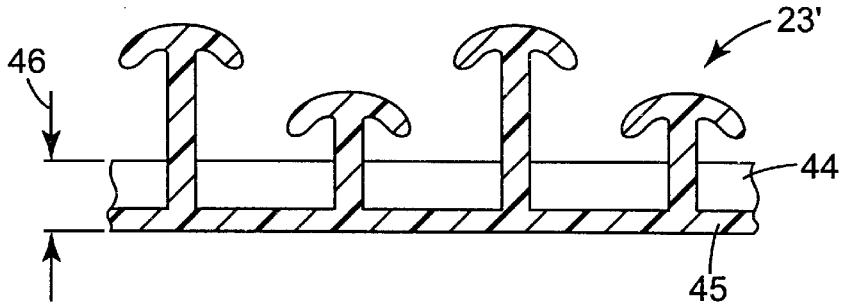
FIG. 12 is a sectional view of the fastener of FIG. 11.
Figure 13:
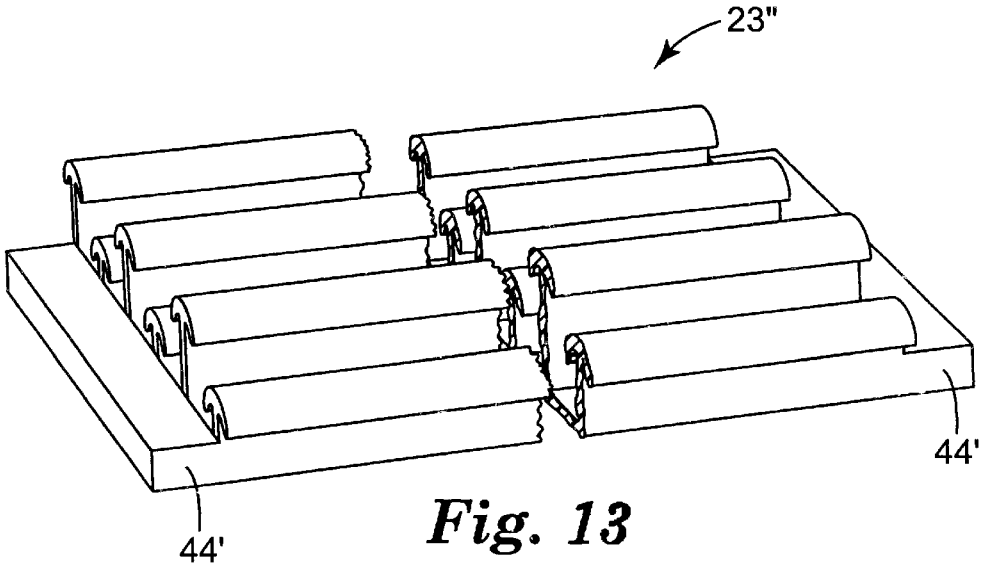
FIG. 13 is a perspective, broken view of a different fastener of the invention.

Deformations of the rib structure, such as caused by periodic contact of the ribbed surface of an extruded web with projections from a hot wheel, are useful to limit relative lengthwise movement between fasteners of a fastener pair. One such deformation structure, in the form of a dam, is illustrated in FIGS. 11–13. FIG. 11 is a perspective view of a fastener 23', similar to the fastener 23 shown in FIGS. 4 and 10, but modified by formation of a raised structure or dam 44. Such dams can be conveniently formed by contact of the ribbed surface of an extruded web with projections on a heated wheel, whereby longitudinally spaced portions of the ribbed structure are periodically pressed down and accumulate as a raised structure or dam 44. As shown in FIG. 12, the dam 44 has a greater height or thickness than the base sheet 45. The height 46 of the dam is sufficient that when the fastener 23' is mated with another ribbed fastener, at least the tallest ribs of the other fastener will engage the dam and impede or prevent relative sliding movement between the fasteners of the fastener pair. A dam may be provided on only one side or end of the fastener to limit movement in one direction, or a dam may be provided on both sides or ends of the fastener, as illustrated in FIG. 13, showing dams 44' on opposite ends of a fastener 23". With the fastener 23", sliding type movement is limited in two opposite directions. Instead of a dam taking the form of structure raised above the base sheet, rib deformations such as widening of the rib by pressing upper portions of the rib toward, but not all the way into contact with, the base sheet may be used.

In other embodiments of the invention a friction-reducing agent is incorporated into a fastener of the invention, e.g., on the rib surfaces to enhance relative movement between the interengaged ribs of a fastener pair. Such friction-reducing agents, for example silicone materials such as discussed below in connection with release agents, also have the advantage that they help molten polymeric material flow during extrusion or other forming of the fastener body and thus assist the material to fill out the desired rib shape.

Fasteners of the invention may be made from a variety of materials but most commonly are made from polymeric materials, using generally any polymer that can be melt processed. Homopolymers, copolymers and blends of polymers are useful, and may contain a variety of additives. Inorganic materials such as metals may also be used. The composition is chosen to provide desired bending characteristics, including usually an elastic bending movement of the stem of the rib in a direction lateral to the length of the rib and little if any bending of the flanges during engagement and disengagement. Generally a modulus of from $10^3$ MPa to $10^7$ MPa for the composition of the fastener including any additives is satisfactory but this may change depending on the application.

Suitable thermoplastic polymers include, for example, polyolefins such as polypropylene or polyethylene, polystyrene, polycarbonate, polymethyl methacrylate, ethylene vinyl acetate copolymers, acrylate-modified ethylene vinyl acetate polymers, ethylene acrylic acid copolymers, nylon, polyvinylchloride, and engineering polymers such as polyketones or polymethylpentanes. Elastomers include, for example, natural or synthetic rubber, styrene block copolymers containing isoprene, butadiene, or ethylene (butylene) blocks, metallocene-catalyzed polyolefins, polyurethanes, and polydiorganosiloxanes. Mixtures of the polymers and/or elastomers may also be used.

Suitable additives include, for example, plasticizers, tackifiers, fillers, colorants, ultraviolet light stabilizers, antioxidants, processing aids (urethanes, silicones, fluoropolymers, etc.), low-coefficient-of-friction materials (silicones), conductive fillers to give the fastener a level of conductivity, pigments, and combinations thereof. Generally, additives can be present in amounts up to 50 percent by weight of the composition depending on the application.

Fasteners of the invention can be formed by extruding a polymeric web through a die having an opening cut, for example, by electron discharge machining.

The shape of the die is designed to generate a web with a desired cross-sectional shape or profile. The web is generally quenched after leaving the die by pulling it through a quenching material such as water. A wetting agent may be required in the quenching medium to assure good wetting of the whole surface of the extruded web, including spaces between ribs. The extruded web may be further processed, e.g., by cutting extruded ribs and stretching the web to form interruptions in the ribs or by forming structure to limit relative movement between fasteners. Fasteners are then formed, generally by cutting and slitting the extruded web.

Extrusion is strongly preferred; but instead of extruding, fasteners of the invention can be prepared in other ways, for example, by injection molding or casting. Also, ribbed fastener structure of the invention can be incorporated into a larger article having other functions beside fastening, e.g., a frame that could be mounted on a wall to support a picture or other display. The fastener structure can be incorporated into the larger article in various ways, e.g., by inserting an already prepared fastener into a mold and molding the rest of the article around the fastener; or by configuring a mold surface with mold structure shaped to form a fastener structure of the invention. When ribbed fastener structure of the invention is incorporated into a larger article, the term "base sheet" herein includes the structure of the article into which the fastener structure is incorporated.

As previously stated, the body of a fastener of the invention may include multiple layers, generally of different composition. Such multiple layers can be provided by coextrusion techniques (as described, for example, in published PCT Appln. No. WO 99/17630, published Apr. 15, 1999), which may involve passing different melt streams from different extruders into a multiple-manifold die or a multiple-layer feed block and a film die. The individual streams merge in the feed block and enter the die as a layered stack that flows out into layered sheets as the material leaves the die. The die is patterned so as to form the ribbed configuration of the fastener. A fastener of the invention thus may have a base sheet of one composition and ribs of a different composition. Or a portion of the ribs, e.g., the top edge-portion of the rib as shown in FIG. 8*j*, may have a different composition from other portions of the rib. For example, the top portion of the rib may include a composition that forms a lower-friction surface than the rest of the rib.

Fasteners of the invention have a number of important advantages, which adapt the fasteners to a number of important uses. For example, because the fasteners are self-mating, inventory requirements and related costs are reduced. Also, a single fastener can be used as a closure device, as when the fastener takes the form of a tape or strap wrapped around a bundle of items and closed by overlapping and pressing together the ends of the strap. The base sheet of the fastener should have adequate tensile strength to resist tensions on the strap during use, which may be provided by choice of composition of the base sheet, manufacture of the fastener as a coextruded product with a material for the base sheet specially adapted for use as a tensile strap, or addition of a sheet or layer to the base sheet. The strap may be twisted to allow the ribbed surfaces at the respective ends of the strap to interengage. Or ribs may be provided on both sides of the base sheet (i.e., both major or large-area surfaces of the base sheet), or opposite ends of the strap may have ribs on opposite surfaces of the strap, with the result that ribs may be interengaged without twisting the strap. The term "fastener pair" used herein includes assemblies in which the interengaged elements are sections of the same fastener.

Another occasion for pressing together different portions of the ribbed surface of the same fastener is the folding over onto itself of an end portion of a fastener-tape of the invention to form a tab useful for handling a fastener, e.g., for opening a mated or interengaged fastener pair. Upon folding over and pressing of the end portion of the fastener-tape into contact with an adjacent portion of the fastener, the ribbed surfaces of the contacting surfaces become interengaged and hold the end portion in its folded-over configuration.

As noted above, the achievement of high peel forces by fasteners of the invention is another major advantage. For example, peel strength can be important when fasteners of the invention are used as a bundling strap. Further, fasteners of the invention are useful as a closure device for garments, upholstery and similarly flexible items, where the flexibility of the item can cause the closure devices to experience peel-type stress.

In addition to good peel resistance, fasteners of the invention also offer good resistance to tensile forces perpendicular to the base sheet of the fastener, which arise when the fastener is used on a rigid substrate. Also, fasteners of the invention have good resistance to shear forces acting (parallel to the base sheet) across the lengthwise direction of the ribs on the fastener. Fasteners of the invention can be used to attach floor covering or carpeting to a floor surface or roofing to a roof surface; in such cases the tensile and shear resistance of the fastener may be useful together with its peel resistance. However, the fasteners can be made to offer low resistance to shear in the lengthwise direction of the ribs, which may be useful, for example, when the fastener is used to attach wall fixtures and panels, where some linear adjustment of the applied item may be desired. Low lengthwise shear resistance may also be useful in clothing and other apparel. As noted above, fasteners of the invention may include means to limit relative movement of fasteners in the lengthwise direction.

When fasteners of the invention having continuous ribs are interengaged, they can provide a barrier to penetration of fluids through the mated fasteners, which can be useful in certain applications.

Mated fasteners of the invention generally have a low thickness, which is a useful property in many applications, such as for mounting automotive trim, wall coverings, and signage, or as a closure for envelopes or packages such as bandage packages.

Figure 14:
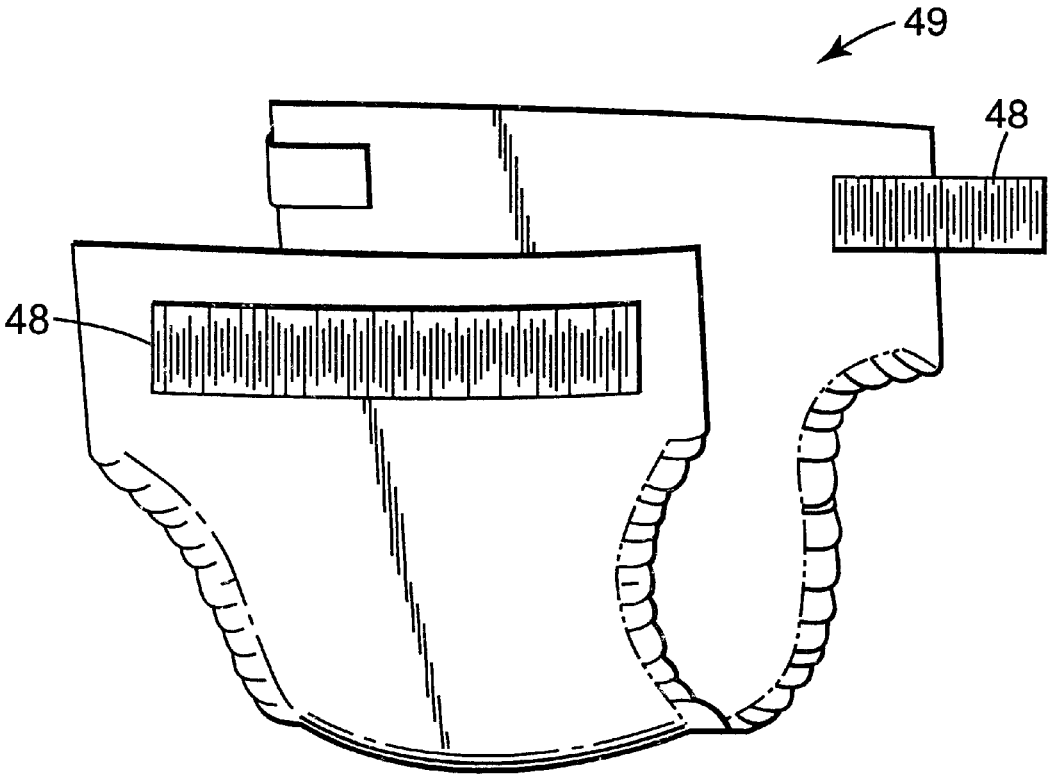
FIG. 14 is a partially schematic perspective view of a diaper of the invention, to which fasteners of the invention are attached.
Figure 15:
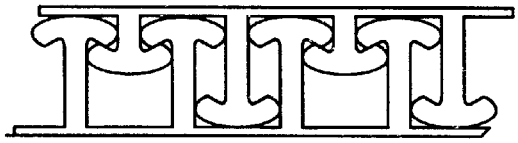
FIG. 15 schematically shows a portion of a fastener having tall and short ribs interengaged with a different fastener having all ribs of the same height.
Figure 16:
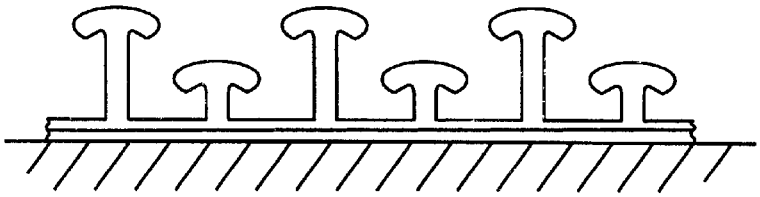
FIG. 16 schematically shows a portion of a fastener attached to a rigid substrate of an article.
Figure 17:
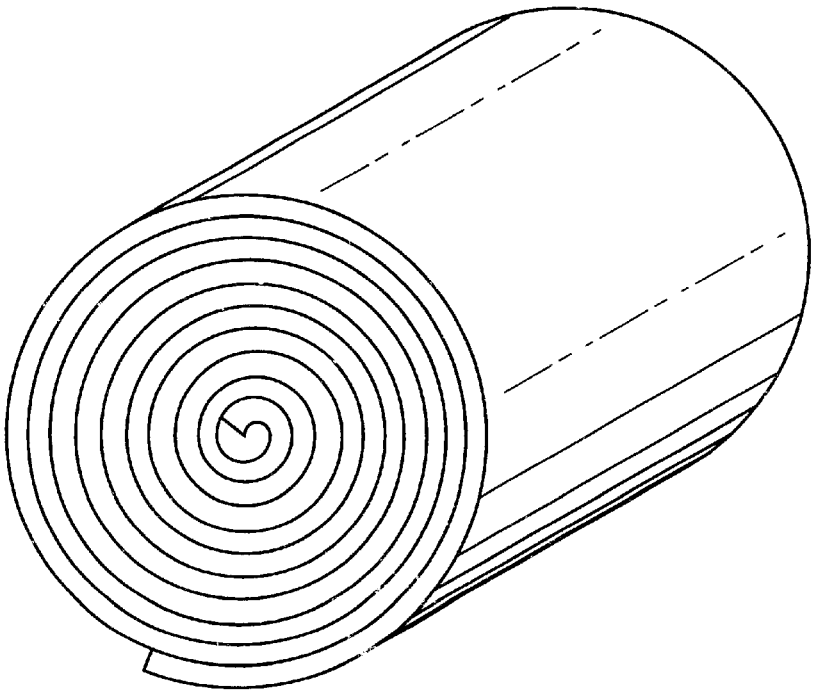
FIG. 17 shows a fastener tape wound upon itself for storage.
Figure 18:
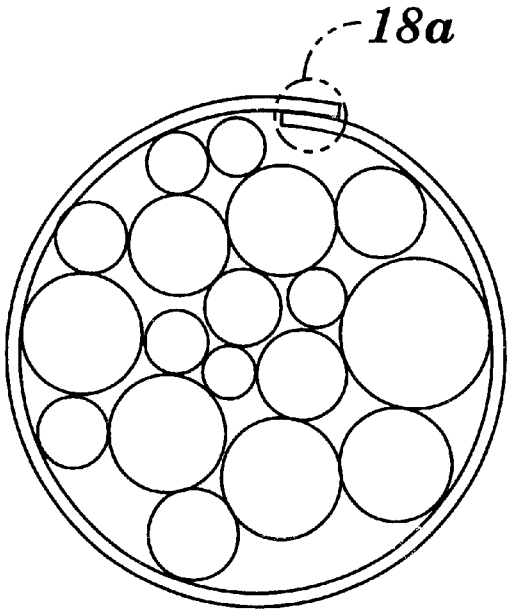
FIG. 18 shown a bundling strap wrapped around a bundle of items.
Figure 18A:
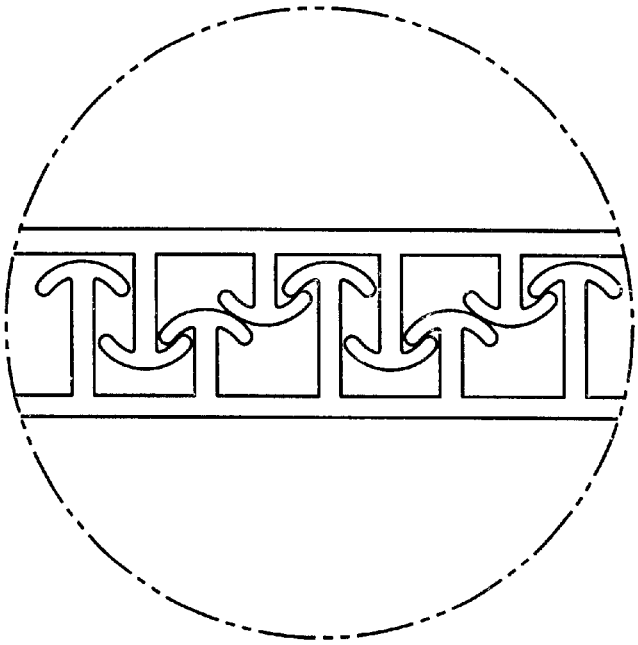
FIG. 18*a* is an enlarged view of the joined ends of the strap shown in FIG. 18.

The ribbed nature of fasteners of the invention provides a desired alignment feature to the fasteners. For example, by using self-mating fasteners of the invention on portions of a garment that are to be joined together, the garment portions will necessarily come together in an orientation determined by the orientation in which the fasteners are attached or adhered to the garment portions. This feature is illustrated in FIG. 14, which shows a fastener of the invention 48 in use on a diaper 49. One fastener 48, which takes the form of a tape or strip, with ribs transverse to the length of the strip, is attached to one corner of the diaper; and a second mating ribbed fastener 48 is attached to another corner that is to be connected to the first corner in closing the diaper about an infant or other wearer. The basic orientation that the connected corners will have is established by attaching the fasteners 48 in a desired orientation on the diaper 49. When the diaper 49 is closed about a wearer, the corners become connected in the desired orientation because of the orientation established by the ribbed nature of the mating surfaces of the fasteners 48. Diapers (as well as other garments) carrying closures that comprise fasteners of the invention attached to the diaper in desired base orientations and mating with one another in accordance with the ribbed pattern of the fasteners are an important advantageous product of the invention.

The orientation-assisting mating of fasteners occurs whether the ribs are transverse to the length of the fastener, or parallel, to the length, or in another orientation such as diagonal to the length of the fastener. Also, the ribbed alignment is further assisted by a deviation in ribbed-surface profile, which as discussed above, can cause the mating fasteners to come together with ribs from one fastener aligned with spaces between ribs of the other fastener.

Although fasteners of the invention generally are used in self-mating pairs, they also can be interengaged with a fastener of a different shape. For example, a fastener having tall and short ribs as illustrated in FIG. 4 may be interengaged with a fastener in which the ribs are all the same height.

In some embodiments of the invention, the surface of the base sheet opposite from the ribbed surface carries structure that specially adapts the fastener to attachment to another substrate. Such structure may include ribbed surfaces of the invention in which the rib profile is the same or different from that on the first surface, as well as other mechanical fastening structure such as hooks or loops or headed elements as described, for example, in U.S. Pat. No. 4,290,174, or various adhesive layers. Fasteners of the invention may also be attached onto a substrate by means separate from the fastener, e.g., by a separately applied adhesive, by sewing, welding of base sheet material to the substrate, and other means.

When taking the form of a tape, a fastener of the invention is generally wound into a roll for convenient storage and use. If the tape carries a layer of adhesive on the surface opposite from the ribbed surface, particularly a layer of pressure-sensitive adhesive, a release liner may be used between windings to assure easy unwinding of the roll. Alternatively, a release material may be incorporated into the fastener, e.g., into the ribs or outer rib surface portions; or a release material may be applied to the surface of the fastener that winds against the adhesive layer. Examples of release control agents that may be incorporated into the fastener include graft polymers such as the fluorochemical graft polymers disclosed in PCT Application No. 9215626 (Rolando et al.). Examples of release agents that may be applied to the surface of the fastener include urethanes such as disclosed in U.S. Pat. No. 2,532,011 (Dahlquist et al.), reactive silicones, fluorochemical polymers, epoxysilicones such as disclosed in U.S. Pat. No. 4,313,988 (Bany et al.) and U.S. Pat. No. 4,482,687 (Kessel et al.), and radiation-curable polyorganosiloxane-polyurea block copolymers such as disclosed in European Application No. 250248 (Leir et al.).

EXAMPLES

The invention is further illustrated by the following examples, which are not intended to limit the scope of the invention. In the examples, parts, ratios and percentages are by weight unless otherwise indicated.

The following test methods were used to characterize exemplary fasteners in the examples:

Rigid Engagement Test

Self-mating fasteners having flexible base sheets with ribs aligned transverse to the length of the fastener are bonded to rigid substrates and tested for the force needed to engage the two fasteners. The fasteners are bonded by an adhesive such as 3M Scotchweld™ Acrylic Structural Plastic Adhesive DP-8005 to rigid steel block substrates and then trimmed to 12 mm width (the dimension transverse to the length of the ribs). The sample bonded to the lower block is approximately 25 mm long but that on the upper block is trimmed to a length containing 6 ribs (approximately 8 mm). The two blocks are brought together, with mating surfaces facing one another, as parallel planes at 5 mm/min. A real-time magnified video image is recorded through the time until engagement is complete. An Instron™ tensile tester, Model 4501, is used to control the motion carefully and to measure the force continuously. The measured response is the maximum compressive stress as measured in Pascals anytime during engagement. A desirable outcome of this test is low engagement stress.

Rigid Disengagement Test

Self-mating fasteners supported on a rigid substrate are tested for force needed to disengage the fasteners after they have been fastened. This test is a continuation of the rigid engagement test described above. After engagement is complete and the motion has been halted momentarily, the engaged mating surfaces are moved apart at 5 mm/min. The force is continuously recorded until full disengagement is obtained. The measured response is the maximum tensile stress as measured in Pascals anytime during disengagement. A desirable outcome of this test is a high disengagement stress. The ratio of maximum disengagement stress to maximum engagement stress is desired to be as high as possible when combining the results of the engagement and disengagement tests.

Flexible Pinch Test

Self-mating fasteners having flexible base sheets are tested for force needed to engage the two surfaces by a pinching action. A fastener pair, namely two 12-mm-wide strips of fastener laid against one another with ribbed surfaces facing together, are draped over a pinch roller and over side support tables that flank the roller. Then an upper pinch roller (rigidly attached to an Instron™ load cell) is lowered to push the fastener pair together. The sequence is stopped when the pair mate as determined from viewing a real-time magnified video image of the nip. One layer of foam tape (such as 3M #114, which comprises an acrylate pressure-sensitive adhesive on an acrylic foam core having a thickness of 1.5 mm and a Shore A hardness of 50 durometers) is applied to each roller to spread and cushion the load. The goal is to make this test similar to two human fingers squeezing the strips together, and to include the cushioning effect of skin and flesh between the fastener and bone. The use of the rollers allows the side-to-side displacement that human fingers may undergo as they pinch something together. The maximum force measured is normalized by the tape width and reported as Newtons per lineal decimeter (N/dm). Tests can be performed on unbacked samples (mode A) and sample films laminated to 12-mm-wide strips of stainless steel shim stock 0.1 mm thick by a pressure-sensitive-adhesive transfer film such as 3M VHB Transfer Adhesive (mode B). A desirable response for this test is full engagement at a very low maximum compressive force.

Zip Test

Self-mating ribbed fasteners having flexible base sheets are tested for the force needed to engage the two surfaces by a zipping action, to mimic the sliding of pinched fingers along a length of fastener to propagate engagement. Two 12-mm-wide strips of fastener, with ribs extending transversely to the length of the fastener, are faced towards each other and manually engaged at one end. The engaged end is then clamped and inserted between two rollers each having a diameter of approximately 25 mm. The two rollers are placed close enough to each other to force complete mating of the two pieces. The force required to pull the mated ends through the gap in the rollers at 250 mm/min is then measured as a function of time. This force is averaged over approximately 50 mm of displacement, normalized by the tape width, and reported as Newtons per lineal decimeter. Tests can be performed on unbacked samples (mode A) and sample films laminated to 12-mm-wide strip of stainless steel shim stock of thickness 0.1 mm by a pressure-sensitive-adhesive transfer film (mode B). A desirable response for this test is full engagement at a very low pulling force.

T-Peel Test

Self-mating ribbed fasteners having flexible base sheets are tested for force needed to disengage the two surfaces by a peeling action after they are fastened. Two 12-mm-wide strips of fastener, with ribs extending transverse to the longest dimension of the fastener, are faced towards each other and engaged by hand using a sideways insertion (the strips are laid side to side and parallel to one another, and the strips are then moved sideways into engagement, with ribs on the facing fasteners interengaged) and a visual inspection for mating completeness. At one end of the strip, the two fasteners are separated for a short distance and these separated ends are each clamped and then peeled apart at 250 mm/min. This force is averaged over approximately 50 mm of displacement and normalized by the tape width and reported as Newtons per lineal decimeter. Tests can be performed on unbacked samples (mode A) and sample films laminated to 12-mm-wide strip of stainless steel shim stock of thickness 0.1 mm by a pressure-sensitive-adhesive transfer film (mode B). A desirable response for this test is a high peeling force. This peel is generally performed in the cross-direction (perpendicular to the ribs). Generally it is desired that the ratio of pinch force to peel force measured in the described tests be low.

EXAMPLES 1–2

The fasteners of Examples 1–2 illustrate the effect of profile deviation caused by alternating ribs of different heights across the fastener, particularly the effect on engagement and disengagement properties when the fasteners are rigidly supported.

In Example 1, a melt-processable, ethylene-propylene copolymer (7C55H, obtained from Shell) was fed into two single-screw extruders. The first extruder (supplied by Davis Standard Corporation) had a diameter of about 38 mm (1.5 in) and an L/D (ratio of length to diameter) of 30:1; and the second (supplied by Killion Extruders Inc.) had a diameter of about 32 mm (1.25 in), and an L/D of 42:1. The material in each extruder was passed through the extruder and continuously discharged at a pressure of at least about 0.69 NPa (100 psi) through a heated neck tube and into one port of a three-layer feed block (supplied by Cloeren Co.) that was set up for two layers. The feedblock was mounted on a 20.3-cm-wide (8 in.) Masterflex™ LD-40 film die (supplied by Chippewa Valley Die, Inc.). Both extruders were operated with a temperature profile that steadily increased from approximately 177° C. (350° F.) to approximately 246° C. (475° F.). The feed block and die were set at approximately 246° C. (475° F.).

The die had a die lip configured to form a polymeric base sheet with ribs on one side. The base sheet had a thickness of about 150 microns ($\mu$m) and the ribs had a cross-section similar to that of FIG. 4*a,* with tall ribs 24 and short ribs 25 alternating across the width of the extruded web. Rib 24 had a height of 1.32 mm (the dimension 51 in FIG. 4*b*, measured from the upper surface of the base sheet to the topmost portion of the flanges), a stem thickness or width of 0.25 mm (the dimension 52 in FIG. 4*b*, measured at the mid-height of the tall stem), a flange thickness of 0.23 mm (the dimension 53 in FIG. 4*a*, measured at the point where the flange is connected to the stem), a flange width of 0.43 mm (the dimension 54 in FIG. 4*a*, which is the average distance from the center of the stem to the farthest point on the flanges, measured in a plane parallel to the base sheet), and a flange orientation such that the flange formed an angle with the horizontal plane of the base sheet of about 20° (the angle a in FIG. 4*c*). Rib 25 was similar to Rib 24 except the rib height (55 in FIG. 4*b*) was 1.11 mm such that the height ratio of the alternating high and low ribs was approximately 1.2.

The extruded ribbed-surface film was drop cast at about 2.4 m/min into a quench tank maintained at a temperature of about 18° C. (65° F.) for about 10 seconds. The quench medium was a solution of water and about 0.6 parts by weight per 100 parts water of a surfactant, Ethoxy CO-40 (a polyoxyethylene castor oil available from Ethox Chemicals, LLC, Greenville, S.C.) to increase wetting and stabilize rib formation. The quenched rib-surfaced film was air-dried and collected for testing.

Example 2 was made in a manner similar to that of Example 1 except a different die lip was used. The die lip of Example 2 was configured to result in adjacent ribs with alternating heights of 1.15 mm and 0.75 mm, such that the height ratio of the alternating high and low ribs was approximately 1.5. The width of the stem of each rib and the width and thickness of the flanges on adjacent ribs for both examples were similar to those of Example 1.

Comparative Example 1 was made as Example 1 except the die lip was configured to result in adjacent ribs all having substantially the same height as the high rib of Example 1. As in Example 1, the ribs of Comparative Example 1 had a height of 1.29 mm, a stem thickness of 0.25 mm, a flange width of 0.42 mm, a flange thickness of 0.25 mm, and a flange that angled below the horizontal plane of the major surface of the base film by about 20°.

Self-mating ribbed strip-fasteners were cut from the formed webs, with the ribs transverse to the length of the cut strip, and tested in the rigid engagement and disengagement tests. Measurements were repeated three times on two different sample sets cut from each example web, and the average of all six measurements is set forth in Table 1.

TABLE 1

| Example | Height Ratio | Engagement kPa | Disengagement kPa | Disengage/Engage Ratio |
|---|---|---|---|---|
| 1 | 1.2 | 300 | 345 | 1.2 |
| 2 | 1.5 | 225 | 260 | 1.3 |
| CE1 | 1.0 | 560 | 580 | 1.1 |

As seen in Table 1, the engagement force decreased as the height ratio increased, a result understood to occur because the increased height ratio allowed a rib to move more easily to make room for an engaging rib; also, at the lower height ratio (Example 1) the flanges on the shorter ribs could move past and interengage with flanges on the shorter ribs of the mating fastener, which required added force to accomplish. Disengagement forces also decreased with increasing height ratio, because of two mechanisms: more room for a disengaging rib to move in disengaging movement, and the number of ribs actually disengaging decreases as the height ratio increases (in Example 2 the flanges on the shorter ribs had not become engaged with flanges of the mating shorter ribs during engagement). Importantly, the disengagement/engagement ratio increased with an increase in the height ratio.

EXAMPLE 3

The fasteners of Example 3 illustrate the effect of profile deviation in the form of flange location with respect to the base sheet, particularly the effect on engagement and disengagement properties when the fasteners are rigidly supported.

Example 3 was made in a manner similar to that of Example 1 except a different die lip was used. The die lip was configured to result in a flange on each side of the stem but at different heights from the base sheet as illustrated in FIGS. 1–3. The heights of the left and right flanges (the dimensions 40 and 42, respectively, shown in FIG. 2*a*, which are measured from the top surface of the base sheet to the point where the upper surface of the flange intersects the stem) were 1.17 mm and 0.74 mm, respectively. The width (dimension 41 in FIG. 2*a*), thickness and angle with the base sheet of the higher flange 16 were 0.37 mm, 0.20 mm, and around 30°, respectively. The width, thickness and angle with the base sheet of the lower flange 15 were 0.37 mm, 0.20 mm, and around 30°, respectively. The stem had a thickness of about 0.20 mm.

The fastener of Example 3 was tested in the rigid engagement and disengagement tests. The results (average of six measurements—three measurements on two sample sets) are set forth in Table 2.

TABLE 2

| Example | Engagement kPa | Disengagement kPa | Disengagement/ Engagement Ratio |
|---|---|---|---|
| 3 | 92 | 210 | 2.2 |

As seen in Table 2, the disengagement force was more than the engagement force in this example, in which the flanges on opposite sides of the stem are spaced different distances from the base sheet. These results may be compared to the results for Comparative Example 1 in Table 1, in which flanges on opposite sides of the stem are spaced the same distance from the base sheet, and which exhibits a disengagement/engagement ratio of almost 1.

EXAMPLE 4

The fasteners of Example 4 illustrate the effect of profile deviation by rib spacing on engagement and disengagement properties when the fasteners are rigidly supported.

The Example 4 fasteners were made from the fasteners of Comparative Example 1. As in Comparative Example 1, all the ribs had a height of 1.29 mm, a stem thickness of 0.25 mm, a flange width of 0.42 mm, a flange thickness of 0.25 mm, and a flange angle with the base sheet of about 20°. The fasteners of Example 4 were created by carefully removing every third row from the fastener of Comparative Example 1, leaving a fastener as illustrated in FIG. 6.

The prepared fasteners were tested for rigid engagement and disengagement in two orientations—with two ribs fit into the space left by a missing row (Orientation M), and with one rib fit into the space left by a missing row (Orientation N, illustrated in FIG. 6). The results (average of six measurements—three measurements on two sample sets) are set forth in Table 3.

TABLE 3

| Example (orientation) | Engagement kPa | Disengagement kPa | Disengage/Engage Ratio |
|---|---|---|---|
| 4(M) | 35 | 45 | 1.2 |
| 4(N) | 350 | 345 | 1.1 |
| CE 1 | 560 | 580 | 1.1 |

As seen in Table 3, removing rows to create spacing deviations or asymmetry significantly lowers the engagement and disengagement forces of these self-mating fasteners, which may be beneficial for certain applications.

Examples 5–6 and Comparative Example 2

The fasteners of Examples 5–6 illustrate the effect of profile deviation achieved by use of ribs of different heights alternating across the width of the fastener, particularly the effect on flexible-mode engagement and disengagement properties, i.e., when flexible fasteners are unsupported or flexibly supported.

Examples 5–6 and Comparative Example 2 were made as Examples 1–2 and Comparative Example 1, respectively, but the fasteners were tested in two flexible modes, Mode A (without support) and Mode B (with stainless steel sheet support), for pinch engagement, zip engagement and peel disengagement. The results (average of four measurements—measurements repeated twice on two different sample sets from each prepared web) are set forth in Table 4.

TABLE 4

| Example | Support | Height Ratio | Pinch N/dm | Zip N/dm | Peel N/dm | Pinch/Peel Ratio |
|---|---|---|---|---|---|---|
| 5 | A | 1.2 | 125 | 9.9 | 41 | 3.1 |
| 6 | A | 1.5 | 15 | 8.8 | 25 | 0.6 |
| CE2 | A | 1.0 | 390 | 5.3 | 35 | 11 |
| 5 | B | 1.2 | 270 | 18 | 34 | 7.9 |
| 6 | B | 1.5 | 63 | 8.6 | 15 | 4.2 |
| CE2 | B | 1.0 | 285 | 12 | 32 | 8.9 |

As seen in Table 4, the ratio of pinch force to peel force was substantially less for the fasteners of the example than for fasteners of the comparative example when the fasteners were tested without a stiffening support. In addition, as more room became available for the ribs to engage (from Example 5 to Example 6), the ratio of the pinch and peel forces decreased in both the supported and unsupported tests. Comparison of the unsupported and supported tests also shows that the ratio of pinch and peel forces was higher in the supported tests.

EXAMPLE 7

The fasteners of Example 7 illustrate the effect of profile deviation achieved by flange location, particularly the effect on flexible-mode engagement and disengagement properties. The fasteners of Example 7 were made as those of Example 3, but they were subjected to different tests and tested in two flexible modes, Mode A (without support) and Mode B (with stainless steel sheet support). The fasteners were tested for pinch engagement, zip engagement and peel disengagement. The results (average of four measurements—measurements repeated twice on two sample sets) are set forth in Table 5.

TABLE 5

| Example | Support | Pinch N/dm | Zip N/dm | Peel N/dm | Pinch/Peel Ratio |
|---|---|---|---|---|---|
| 7 | A | 12.5 | 2.0 | 23 | 0.54 |
| 7 | B | 38 | 2.0 | 8.5 | 4.5 |

As seen in Table 5, the ratio of pinch and peel forces for fasteners of this example was especially low for Example 7A, where the fastener was tested without support. Also, the pinch/peel ratios of Examples 7A and 7B were much lower than those ratios for Comparative Examples 2A and 2B (reported in Table 4), illustrating the benefit of profile deviation achieved by lowering flange height on one side of the stem portion.

EXAMPLE 8

The fasteners of Example 8 illustrate the effect of profile deviation achieved by rib spacing, particularly the effect on flexible-mode engagement and disengagement properties. The fasteners of Example 8 were made the same as the fasteners of Example 4, but they were subjected to different tests and were tested in two modes, Mode A (without support) and Mode B (with stainless steel sheet support). The fasteners were tested for pinch engagement, zip engagement and peel disengagement in two different orientations—with two ribs fit into a missing row (Orientation M) or one rib fit into a missing row (Orientation N, illustrated in FIG. 6). The results (average of four measurements—two measurements on two different sample sets) are set forth in Table 6 together with those of Comparative Example 2.

TABLE 6

| Example (orientation) | Support | Missing Row | Pinch N/dm | Zip N/dm | Peel N/dm | Pinch/Peel Ratio |
|---|---|---|---|---|---|---|
| 8(M) | A | every 3rd | 2.7 | 0.95 | 10.2 | 0.3 |
| 8(N) | A | every 3rd | 46 | 3.6 | 30 | 1.5 |
| CE2 | A | none | 390 | 5.3 | 35 | 11 |
| 8(M) | B | every 3rd | 8.6 | 1.8 | 7.0 | 1.2 |
| 8(N) | B | every 3rd | 105 | 7.7 | 20 | 5.1 |
| CE2 | B | none | 285 | 23 | 32 | 8.9 |

As seen in Table 6, the engagement forces and disengagement forces are affected by whether mating involves the inclusion of one or two ribs in the corresponding space. However, in both cases, the pinch/peel ratio was substantially lower for the examples than for the comparative example.

EXAMPLES 9–11

The fasteners of Examples 9–11 illustrate the effect of rib length, longitudinal distance between ribs, and profile deviation (by alternating rib height across the width of the fastener). The fasteners of Examples 9–11 were made as those of Example 2 except with different process equipment. A single screw extruder (Killion) having a diameter of 64 mm (2.5 in) and an L/D of 24/1) was used. Rib-surfaced films were extruded, quenched and dried as in Example 2. The films were subsequently passed over a curved vacuum platen preheated to 85° C. (185° F.) and then under a rotating wheel having 36 evenly spaced knife blades, which cut the ribs into evenly spaced, discrete sections, as outlined in U.S. Pat. No. 4,894,060. The knife blade wheel rotated at about 500 rpm and the web speed was adjusted such that the distance between cuts along a single rib varied from example to example, producing different-length ribs. Lengths can be indicated by the ratios of rib length to stem thickness, which for Examples 9–11 were, respectively approximately 3 (i.e., stem thickness was 0.01 inch (0.25 mm) and rib length was 0.03 inch (0.75 mm)), 4.5, and 9. After cutting of the ribs, the film was lengthwise stretched about 10% under a temperature maintained at approximately 150° C. (300° F.). The lengthwise stretching resulted in longitudinal spaces between longitudinally adjacent cut ribs of about 0.075, 0.11 and 0.4 mm, respectively. A simultaneous reduction in transverse spacing between transversely adjacent ribs was negligible.

The fasteners were then tested in two modes, without support and with stainless steel sheet support, for pinch engagement, zip engagement and peel disengagement, and the fasteners exhibited useful properties. The fasteners were all more flexible in the direction parallel to rib length than uncut samples.

EXAMPLE 12

Example 12 illustrates a fastener of the invention made from polyethylene. Example 12 was made as Example 2 except the polymer was LDPE 6005 (obtained from Union Carbide Corporation) and the films were tested for self-mating engagement and disengagement in a rigid format. Measurements were repeated two times on two different sample sets cut from each example web, and the average of all four measurements is set forth in Table 7, together with results from Example 2 for comparison.

TABLE 7

| Example | Height Ratio | Engagement kPa | Disengagement kPa | Disengage/Engage Ratio |
|---|---|---|---|---|
| 12 | 1.5 | 535 | 420 | 0.8 |
| 2 | 1.5 | 225 | 260 | 1.3 |

As seen in Table 7, the engagement and disengagement forces may change when the polymer from which a fastener of the invention is made is changed.

EXAMPLES 13–14

Examples 13 and 14 illustrate the effect on the performance of a rigidly supported fastener of the invention achieved by changing the polymer composition at the upper surface of the ribs of the fastener.

Example 13 was made as in Example 2 except a different polymeric material was passed through one of the extruders. The polymeric material passing through the Killion extruder was a blend of 95% 7C55H polypropylene copolymer (obtained from Shell Corporation) and 5% MB-50 Silicone (a 50/50 silicone/polypropylene blend available from Dow Corning Corporation). This polymeric material formed a surface layer on the top of the ribs (as shown for example in FIG. 8*j*), which had a lower coefficient of friction than that of the base polymer (100% 7C55H polypropylene copolymer), which passed through the Davis Standard extruder to form the bulk of the rib-surfaced film. The flange width of the ribs on the extruded web was 0.40 mm.

Example 14 was made as Example 15 except the polymeric material that passed through the Killion extruder was a blend of 95% of the above-noted 7C55H polypropylene copolymer and 5% of THV-200G transparent fluoroplastic (a tetrafluoroethylene, hexafluoropropylene, and vinylidene fluoride copolymer available from Dyneon Corporation, St. Paul, Minn.). The resulting extruded flange width was 0.45 mm.

The extruded webs of Examples 13 and 16 were cut and tested as self-mating fasteners in the rigid engagement and disengagement tests. Fasteners of both examples showed a useful ratio of disengagement to engagement forces, with the silicone-containing fasteners of Example 13 exhibiting an especially high ratio.

EXAMPLE 15

The fasteners of Example 15 were made by the same procedure as the fasteners of Example 14 but were tested in two flexible modes—without support and with stainless steel sheet support—for pinch engagement, zip engagement, and peel disengagement and exhibited favorable properties.

What is claimed is:

1. A fastener comprising a base sheet and a multiplicity of parallel, narrowly spaced, elastically deformable ribs projecting from the base sheet; the ribs comprising a stem portion attached to and substantially upright from the base sheet and at least one flange attached to each side of the stem portion and spaced from the base sheet; the cross-sectional profile formed by the ribs being substantially uniform over the length of the ribs, but in the direction transverse to the ribs having a regularly repeated deviation from the profile that would be formed by a full population of equally spaced, identical, undivided, symmetric ribs; the deviation from a full-population profile including the absence of structure, at a position adjacent to, and at the same height as, a flange on a plurality of regularly repeating ribs, that would impede movement of the flange during flexure of the rib while the fastener is interengaged with a mating fastener; and the ribs individually having a width that is accommodated between the stem portions of adjacent ribs but is greater than the gap between adjacent ribs, whereby the ribbed surface of the fastener can be interengaged with an identical ribbed surface.

2. A fastener of claim 1 in which the deviation in rib profile is provided by making individual ribs asymmetric in shape with respect to a central upright plane through the rib.

3. A fastener of claim 2 in which the asymmetric shape comprises attachment of the flanges on different sides of the stem portion at different spacings from the base sheet.

4. A fastener of claim 2 in which the asymmetric shape comprises a difference of shape between the flanges on different sides of the stem portion.

5. A fastener of claim 1 in which the deviation in rib profile is provided by making the height of some ribs different from the height of other ribs.

6. A fastener of claim 1 in which the ribs are organized into sets across the fastener in the direction transverse to the ribs and the deviation in rib profile is provided by making the spacing between at least two adjacent ribs in a set different from the spacing between other ribs in the set.

7. A fastener of claim 1 in which the deviation in rib profile is provided by incorporating ribs that are divided by an elongated opening extending from the top of the ribs toward the base sheet.

8. A fastener of claim 1 in which outer portions of the underside surface of at least some rib flanges project toward the base sheet.

9. A fastener of claim 1 in which portions of the topmost surface of at least some of the ribs are angled toward the base sheet to provide a tapered shape to the top of the ribs.

10. A fastener of claim 1 in which at least the topmost portion of the ribs includes a friction-reducing agent to facilitate interengagement of the ribs with the ribs of a mating fastener.

11. A fastener of claim 1 in tape form in which the ribs extend transversely to the length of the tape.

12. A fastener of claim 1 in tape form in which the ribs extend parallel to the length of the tape.

13. A fastener of claim 1 in which at least some of the ribs are interrupted over their length.

14. A fastener of claim 1 in which the ribs are about 2 mm or less in height.

15. A fastener of claim 1 in which the height of the ribs is greater than the width of a flange on the ribs.

16. A fastener of claim 1 in which the base sheet has raised areas transverse to the ribs to limit relative sliding movement between an interengaged pair of fasteners.

17. A fastener of claim 1 in which the ribs have been permanently deformed to limit relative sliding movement between an interengaged pair of fasteners.

18. A fastener of claim 1 prepared by coextrusion from at least two different materials, whereby one portion of the fastener comprises one material and a different portion of the fastener comprises a different material.

19. A mated fastener pair comprising a fastener of claim 1 mated with an identical fastener of claim 1.

20. A mated fastener pair comprising a fastener of claim 1 mated with a different fastener.

21. An article comprising a flexible substrate and a fastener of claim 1 attached to the substrate.

22. An article comprising a fabric and the fastener of claim 1 attached to the fabric.

23. An article comprising a rigid substrate and the fastener of claim 1 attached to the substrate.

24. An elongated fastener in tape form comprising a base sheet and a multiplicity of parallel, narrowly spaced, elastically deformable ribs projecting from the base sheet transverse to the length of the tape; the ribs comprising a stem portion attached to and substantially upright from the base sheet and at least one flange attached to each side of the stem portion, the flanges being attached to the stem portion at points spaced from the base sheet and at least the outer portions of the flanges projecting toward the base sheet at an angle; the cross-sectional profile formed by the ribs being substantially uniform over the length of the ribs, but having a repeated deviation in the direction transverse to the ribs from the profile that would be formed by a full population of equally spaced, identical, undivided, symmetric ribs; the deviation from a full-population profile including the absence of structure, at a position adjacent to, and at the same height as, a flange on a plurality of regularly repeating ribs, that would impede movement of the flange during flexure of the rib while the fastener is interengaged with a mating fastener; the ribs having a length at least 10 times the width of the stem portion and the ribs having a width that is accommodated between the stem portions of adjacent ribs but is greater than the lateral spacing between facing flanges of adjacent ribs; whereby the ribbed surface of the fastener tape can be pressed together with an identical ribbed surface so that the ribs interengage and hold the surfaces together.

25. A fastener of claim 24 in which the ribs have dimensions such that the stem portion flexes when pressure is applied to the rib during interengagement with a mating fastener in preference to deformation of the flanges.

26. A fastener of claim 24 in which the deviation in the profile formed by the ribs includes one or more of a) a rib shape that is asymmetric about a plane perpendicular to the base sheet; b) a height for some ribs greater than the height for other ribs; c) spacing between some ribs greater than the spacing between other ribs; and d) a dividing of at least some ribs by an opening extending from their top surface toward the base sheet.

27. A fastener tape of claim 24 wound upon itself for storage.

28. A fastener of claim 24 in which the ribs have a height of about 2 mm or less.

29. A fastener of claim 24 in which the height of the ribs is greater than the width of a flange on the ribs.

30. A fastener of claim 24 in which at least the topmost surface of the ribs includes a friction-reducing agent to facilitate interengagement of the ribs with the ribs of a mating fastener.

31. A fastener of claim 24 in which at least some ribs are interrupted over their length.

32. A fastener of claim 24 prepared by coextrusion from at least two different materials, whereby one portion of the fastener comprises one material and a different portion of the fastener comprises a different material.

33. A fastener of claim 24 in which the topmost surface of the ribs has a tapered shape with portions angling toward the base sheet.

34. An elongated fastener in tape form comprising a base sheet and a multiplicity of parallel, narrowly spaced, elastically deformable ribs projecting from the base sheet transverse to the length of the tape; the ribs comprising a stem portion attached to and substantially upright from the base sheet and at least one flange attached to each side of the stem portion at points spaced from the base sheet; at least the outer portions of the flanges projecting toward the base sheet; the cross-sectional profile formed by the ribs being substantially uniform over the length of the ribs, but some ribs being taller than other ribs in a regularly repeated pattern in the direction transverse to the ribs; and the ribs individually having a width that is accommodated between the stem portions of adjacent ribs but is greater than the gap between adjacent ribs, whereby the ribbed surface of the fastener can be interengaged with an identical ribbed surface.

35. A fastener of claim 34 in which ribs of a first height alternate one-by-one with ribs of a second height in the direction transverse to the length of the ribs.

36. A fastener of claim 35 in which the first height is about one-and-one-half times the second height.

37. A fastener of claim 35 in which the taller ribs are about 2 mm or less in height.

38. A fastener of claim 34 in which the height of at least the taller ribs is greater than the width of a flange of the ribs.

39. A fastener of claim 34 in which the topmost surface of the ribs has a tapered shape with portions angling toward the base sheet.

40. A fastener of claim 34 in which at least the topmost surface of the ribs includes a friction-reducing agent to facilitate interengagement of the ribs with the ribs of a mating fastener.

41. A fastener of claim 34 in which at least some ribs are interrupted over their length.

42. A garment having separate portions and a fastener attached to the garment for fastening the separate garment portions together, the fastener comprising a flexible base sheet and a multiplicity of parallel, narrowly spaced, elastically deformable ribs projecting from the base sheet; the ribs comprising a stem portion attached to and substantially upright from the base sheet and at least one flange attached to each side of the stem portion at points spaced from the base sheet; the outer portions of the flanges projecting toward the base sheet; the cross-sectional profile formed by the ribs being substantially uniform over the length of the ribs but having a regularly repeated deviation in the direction transverse to the ribs from the profile that would be formed by a full population of equally spaced, identical, undivided, symmetric ribs; the deviation from a full-population profile including the absence of structure, at a position adjacent to, and at the same height as, a flange on a plurality of regularly repeating ribs, that would impede movement of the flange during flexure of the rib while the fastener is interengaged with a mating fastener; and the ribs individually having a width that is accommodated between the stem portions of adjacent ribs but is greater than the gap between adjacent ribs, whereby the ribbed surface of the fastener can be interengaged with an identical ribbed surface.

43. A garment of claim 42 in the form of a disposable diaper.

44. A fastener of claim 1 in which the ribs have dimensions such that the stem portion flexes when pressure is applied to the rib during interengagement with a mating fastener in preference to deformation of the flanges.

45. A fastener comprising a base sheet and a multiplicity of parallel, narrowly spaced, elastically deformable ribs projecting from the base sheet; the ribs comprising a stem portion attached to and substantially upright from the base sheet and at least one flange attached to each side of the stem portion and spaced from the base sheet; the cross-sectional profile formed by the ribs being substantially uniform over the length of the ribs, but in the direction transverse to the ribs having a regularly repeated deviation from the profile that would be formed by a full population of equally spaced, identical, undivided, symmetric ribs; at least the topmost portion of the ribs including a friction-reducing agent to facilitate interengagement of the ribs with the ribs of a mating fastener; and the ribs individually having a width that is accommodated between the stem portions of adjacent ribs but is greater than the gap between adjacent ribs, whereby the ribbed surface of the fastener can be interengaged with an identical ribbed surface.

46. An article adapted to be connected to a surface and to limit passage of fluids through the area of connection comprising sheet material and, mounted on the sheet material, a fastener comprising a base sheet and a multiplicity of parallel, narrowly spaced, elastically deformable ribs projecting from the base sheet; the ribs comprising a stem portion attached to and substantially upright from the base sheet and at least one flange attached to each side of the stem portion at points spaced from the base sheet; at least the outer portions of the flanges projecting toward the base sheet; the cross-sectional profile formed by the ribs being substantially uniform over the length of the ribs, but in the direction transverse to the ribs having a regularly repeated deviation from the profile that would be formed by a full population of equally spaced, identical, undivided, symmetric ribs; the deviation from a full-population profile including the absence of structure, at a position adjacent to, and at the same height as, a flange on a plurality of regularly repeating ribs, that would impede movement of the flange during flexure of the rib while the fastener is interengaged with a mating fastener; and the ribs individually having a width that is accommodated between the stem portions of adjacent ribs but is greater than the gap between adjacent ribs, whereby the ribbed surface of the fastener can be interengaged with an identical ribbed surface; the ribs on the fastener being oriented transversely to the expected course of fluids through the area of connection.

47. An article of claim 46 in which the fastener is mounted on an edge portion of the sheet material, and another fastener is mounted on an edge portion of a different section of the sheet material, whereby the two edge portions can be connected together to limit passage of fluids through the area of connection.

48. An article of claim 47 in which the fastener is a tape attached along an edge portion of the sheet material, and the ribs extend lengthwise of the tape.

49. A fastener comprising a base sheet and a multiplicity of parallel, narrowly spaced, elastically deformable ribs projecting from the base sheet; the ribs comprising a stem portion attached to and substantially upright from the base sheet and at least one flange attached to each side of the stem portion and spaced from the base sheet; the cross-sectional profile formed by the ribs being substantially uniform over the length of the ribs, but some ribs being taller than other ribs in a regularly repeating pattern in the direction transverse to the ribs; and the ribs individually having a width that is accommodated between the stem portions of adjacent ribs but is greater than the gap between adjacent ribs, whereby the ribbed surface of the fastener can be interengaged with an identical ribbed surface.

50. A fastener of claim 49 in which ribs of a first height alternate one-by-one with ribs of a second height in the direction transverse to the length of the ribs.

51. A fastener of claim 50 in which outer portions of the underside surface of at least some rib flanges project toward the base sheet.

52. A fastener of claim 50 in which portions of the topmost surface of at least some of the ribs are angled toward the base sheet to provide a tapered shape to the top of the ribs.

53. A fastener of claim 50 in which at least the topmost portion of the ribs includes a friction-reducing agent to facilitate interengagement of the ribs with the ribs of a mating fastener.

54. A fastener of claim 50 in tape form in which the ribs extend transversely to the length of the tape.

55. A fastener of claim 50 in tape form in which the ribs extend parallel to the length of the tape.

56. A fastener of claim 50 in which at least some of the ribs are interrupted over their length.

57. A fastener of claim 50 in which the ribs are about 2 mm or less in height.

58. A fastener of claim 50 in which the height of the ribs is greater than the width of a flange on the ribs.

59. A fastener of claim 50 in which the base sheet has raised areas transverse to the ribs to limit relative sliding movement between an interengaged pair of fasteners.

60. A fastener of claim 50 in which the ribs have been permanently deformed to limit relative sliding movement between an interengaged pair of fasteners.

61. A fastener of claim 50 prepared by coextrusion from at least two different materials, whereby one portion of the fastener comprises one material and a different portion of the fastener comprises a different material.

62. A mated fastener pair comprising a fastener of claim 50 mated with an identical fastener of claim 50.

63. A mated fastener pair comprising a fastener of claim 50 mated with a different fastener.

64. An article comprising a flexible substrate and a fastener of claim 50 attached to the substrate.

65. An article comprising a fabric and the fastener of claim 50 attached to the fabric.

66. An article comprising a rigid substrate and the fastener of claim 50 attached to the substrate.

67. A fastener of claim 50 in which the ribs have dimensions such that the stem portion flexes when pressure is applied to the rib during interengagement with a mating fastener in preference to deformation of the flanges.

68. A fastener comprising a base sheet and a multiplicity of parallel, narrowly spaced, elastically deformable ribs projecting from the base sheet; the ribs comprising a stem portion attached to and substantially upright from the base sheet and at least one flange attached to each side of the stem portion and spaced from the base sheet; the cross-sectional profile formed by the ribs being substantially uniform over the length of the ribs, but in the direction transverse to the ribs having a regularly repeated deviation from the profile that would be formed by a full population of equally spaced, identical, undivided, symmetric ribs; the deviation comprising attachment of the flanges on different sides of the stem portion at different spacings from the base sheet; and the ribs individually having a width that is accommodated between the stem portions of adjacent ribs but is greater than the gap between adjacent ribs, whereby the ribbed surface of the fastener can be interengaged with an identical ribbed surface.

* * * * *